US007678524B2

(12) United States Patent
Hasegawa et al.

(10) Patent No.: US 7,678,524 B2
(45) Date of Patent: Mar. 16, 2010

(54) MAGNETIC TONER

(75) Inventors: Yusuke Hasegawa, Sunto-gun (JP); Yoshihiro Ogawa, Numazu (JP); Junko Nishiyama, Sunto-gun (JP); Miho Okazaki, Susono (JP); Takashige Kasuya, Sunto-gun (JP); Tomohisa Sano, Sunto-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/416,143

(22) Filed: May 3, 2006

(65) Prior Publication Data

US 2006/0263710 A1 Nov. 23, 2006

(30) Foreign Application Priority Data

May 19, 2005 (JP) ..... 2005-146715

(51) Int. Cl.
*G03G 9/083* (2006.01)

(52) U.S. Cl. ..... 430/111.41; 430/111.4

(58) Field of Classification Search ..... 430/111.4, 430/111.41

See application file for complete search history.

(56) References Cited

U.S. PATENT DOCUMENTS

| | | | | |
|---|---|---|---|---|
| 5,843,610 | A | 12/1998 | Uchida | |
| 5,858,593 | A | 1/1999 | Tamura | |
| 5,874,019 | A | 2/1999 | Uchida | |
| 6,183,925 | B1 * | 2/2001 | Kohri et al. | 430/106.2 |
| 2002/0115007 | A1 * | 8/2002 | Meisen | 430/106.2 |
| 2003/0175518 | A1 * | 9/2003 | Ishitani et al. | 428/403 |
| 2005/0026060 | A1 | 2/2005 | Ogawa | |

FOREIGN PATENT DOCUMENTS

| | | |
|---|---|---|
| EP | 0750233 | 12/1996 |
| EP | 0905088 | 3/1999 |
| EP | 1045292 | 10/2000 |
| JP | 4120153 | 1/1966 |
| JP | 446397 | 3/1969 |
| JP | 4526478 | 9/1970 |
| JP | 50133838 | 10/1975 |
| JP | 55042752 | 3/1980 |
| JP | 58041508 | 3/1983 |
| JP | 59007385 | 1/1984 |

(Continued)

OTHER PUBLICATIONS

Diamond, "Handbook of Imaging Materials," Marcel Dekker, Inc. NY. 1991. pp. 165-170.*

(Continued)

*Primary Examiner*—Mark F Huff
*Assistant Examiner*—Peter L Vajda
(74) *Attorney, Agent, or Firm*—Fitzpatrick, Cella, Harper & Scinto

(57) ABSTRACT

A magnetic toner including at least: a binder resin; and a magnetic body, in which, when magnetization at a magnetic field strength of 397.9 kA/m and a coercive force of the magnetic toner are denoted by σs ($Am^2/kg$) and Hc (kA/m), respectively, a magnetic field strength at which the magnetic toner shows a magnetization value equal to 95% of σs is denoted by H95% (kA/m), and a number average particle size of the magnetic body is denoted by d (μm), H95%, Hc, and d satisfy the following expressions.

$$151<H95\%<200 \quad (1)$$

$$7.1<Hc<12 \quad (2)$$

$$40<Hc/d<150 \quad (3)$$

4 Claims, 2 Drawing Sheets

FOREIGN PATENT DOCUMENTS

| | | |
|---|---|---|
| JP | 3101743 | 4/1991 |
| JP | 3101744 | 4/1991 |
| JP | 4184354 | 7/1992 |
| JP | 4223487 | 8/1992 |
| JP | 07110598 | 4/1995 |
| JP | 07240306 | 9/1995 |
| JP | 7301948 | 11/1995 |
| JP | 7333889 | 12/1995 |
| JP | 09059024 | 3/1997 |
| JP | 9059025 | 3/1997 |
| JP | 2002372801 | 12/2002 |
| JP | 2003098731 | 4/2003 |
| JP | 2003107792 | 4/2003 |

OTHER PUBLICATIONS

Abstract (XP-002398835) for JP 0176396/1989 dated Jul. 1989.

Miwa, et al., "Engineered Magnetite Particle for Electrophotography Toner," Journal of the Imaging Society of Japan, vol. 43, No. 5, 331-344 (2004).

Tokunaga, et al., "Magnetite as Functional Material for Electro-Photography," Material, vol. 34, No. 1, pp. 3-8 (1995).

* cited by examiner

MAGNETIC TONER

BACKGROUND OF THE INVENTION

1. Field of the Invention

The present invention relates to a magnetic toner to be used for visualizing an electrostatic charge image in an image forming method for an electrophotograph or the like.

2. Description of the Related Art

In recent years, from a technical viewpoint, an image forming apparatus has been further requested to have a high speed and long-term high reliability in addition to high definition, high appearance quality, and high image quality. A reduction in particle size of toner and sharpening of a particle size distribution have been attempted to achieve a high-resolution and high-definition development mode. However, when the particle size of toner is merely reduced, dispersibility between a binder resin and another internal additive of a magnetic body reduces, so toner performance is apt to be influenced by the reduction. In particular, the influence is remarkable upon high-speed treatment or after long-term use.

In particular, in the case of magnetic toner used for a one-component development mode in which a reduction in size of an apparatus is advantageous, the dispersed state of a magnetic body in the toner may cause a problem such as the fluctuation or deterioration of anyone of various properties requested for magnetic toner such as development property and durability.

When magnetic body particles are insufficiently dispersed into magnetic toner particles, the total amount of magnetic body particles exposed to the toner particle surfaces is changed by individual magnetic toner particles. When the amount of magnetic body particles on the toner particle surfaces is small, the toner particle surfaces have high charge amounts when they are subjected to triboelectric charging with a charge imparting member (developing sleeve), so charge-up occurs. On the other hand, when the amount of magnetic body particles on the toner particles is excessively large, charge is apt to leak, so a high charge amount is hardly obtained. Moreover, toner opposite in polarity is apt to generate owing to contact between any one of the magnetic body particles and a binder resin, so the width of a charge distribution expands. The expansion may be responsible for the deterioration of image quality. For example, fine-line reproducibility is apt to reduce, or image roughness is remarkable, so it becomes difficult to cope with a recent demand for high image quality.

Magnetic toner contains a magnetic body to provide magnetism, so the magnetic force of the toner causes a toner coat layer on a magnetic toner bearing member (developing sleeve) to form the napping of magnetism. In jumping development using magnetic toner, an image is generally developed from above a magnetic toner bearing member to a photosensitive drum through the application of a developing bias while a nap shape is maintained to some extent.

When magnetic body particles are insufficiently dispersed into magnetic toner particles and a variation in magnetic properties of toner particles is excessively wide, napping is apt to be disturbed. When the napping is disturbed (the napping is excessively long, excessively thick, or is nonuniform in size), for example, a problem in which the napping scatters to the periphery of an image or a problem in which fogging in which a non-image portion is developed with toner is apt to be remarkable occurs.

In addition, when napping is excessively long or excessively thick, a toner mounting height on a photosensitive member increases, so the tailing of a fixed image due to thermocompression fixing is apt to occur. In addition, when the napping shape of magnetism remains even on transfer residual toner, a flaw tends to occur on the photosensitive member owing to rubbing with a cleaning blade.

In addition, such expansion of the width of a charge distribution due to insufficient dispersion of a magnetic body as described above is apt to cause so-called selective development in which toner having a certain range of charge amount distribution is preferentially consumed. At the same time, the progress of the selective development may further accelerate the above problems.

In particular, in order to cope with recent trends toward a high speed and a long lifetime, a large-capacity process cartridge with an increased process speed and an increased toner loading weight in a developing unit has been used. However, the use of such process cartridge tends to make the above problems more remarkable, so quick alleviation of such state has been desired.

Meanwhile, when development conditions are set in such a manner that an image density is sufficiently high (for example, the amplitude of the alternating component of a developing bias is increased), particularly in the case where napping is disturbed, excessive toner is apt to be used for development, so the toner mounting amount of an image increases. As a result, image quality is apt to deteriorate, fogging is apt to be remarkable, or a toner consumption is apt to increase.

When a developing unit is set in such a manner that a toner consumption reduces (for example, the amplitude of the alternating component of a developing bias is reduced), an image density tends to reduce or a line width tends to be small. Therefore, the control of the performance of magnetic toner, in particular, the control of napping due to a magnetic body to be incorporated into the toner is more important than the setting of development conditions for achieving high image quality while maintaining a high image density and a low toner consumption.

With regard to a magnetic body to be incorporated into magnetic toner, each of JP 09-59024 A and JP 09-59025 A has conventionally described magnetite particles each containing 1.7 to 4.5 atom % of Si and less than 10 atom % of one or two or more metal elements selected from the group consisting of Mn, Zn, Ni, Cu, Al, and Ti as a metal element except iron in terms of Si with respect to Fe. The magnetite particles improve magnetic properties and chargeability. However, merely adding the above metals has been still unable to reduce a toner consumption, so the particles are susceptible to improvement.

In addition, JP 04-184354 A, JP 04-223487 A, and the like each disclose a method of reducing the saturation magnetization of toner involving, for example, replacing ferrous of magnetite with a divalent metal such as zinc or copper. However, the method involves the emergence of a problem such as an increase in fogging in a development method using an alternating electric field particularly at a low temperature and a low humidity, so the method is not sufficient for the achievement of the stabilization of image quality or a reduction in consumption.

In addition, each of JP 2003-98731 A, JP 2003-107792 A, and JP2002-372801 A discloses toner causing no image contamination and excellent in fine-line reproducibility while maintaining good chargeability through the control of magnetization in a magnetic field of 5 kOe or 1 kOe. The use of such toner for a two-component developer does exert an excellent effect. However, the magnetization of the toner is so low that the toner cannot be used for a one-component developer. Therefore, the toner has been still unable to alleviate reductions in image quality and developability in long-term use particularly in a high-speed, large-capacity cartridge sufficiently, to reduce a toner consumption sufficiently, and to alleviate the tailing of a fixed image sufficiently, so the toner is susceptible to improvement.

Each of JP 07-301948 A and JP 07-333889 A describes magnetic toner with which a short nap can be formed and a high-quality image can be obtained by adjusting a saturation magnetization amount in a magnetic field of 1 kOe and a value for the product of the weight average particle size and density of the toner. However, napping may be disturbed after the performance of a long-term durability test. As a result, for example, the tailing of a fixed image is apt to occur, fine-line reproducibility is apt to reduce, or a toner consumption is apt to increase. Therefore, the toner must be improved before it is applied to a high-speed machine.

Meanwhile, each of JP 03-101743 A and JP 03-101744 A describes that the particle sizes of magnetic body particles are reduced and a particle size distribution is narrowed for uniformly dispersing the magnetic body particles into toner particles. Those measures surely tend to uniformize the dispersion of the magnetic body particles into the toner particles. However, when the particle size of toner is reduced for achieving high image quality, fogging is accelerated. Therefore, the dispersibility of magnetic body particles into toner particles is susceptible to improvement.

As described above, at present, the realization of magnetic toner which is excellent in durability and developability even when it is applied to a high-speed developing system having a high process speed and using a large-capacity cartridge, which can provide an image with a sufficient image density and high image quality when it is used in a small amount, and which suppresses the tailing of a fixed image and the occurrence of a photosensitive member flaw requires further investigation.

SUMMARY OF THE INVENTION

An object of the present invention is to provide a magnetic toner that has solved such problems as described above.

That is, an object of the present invention is to provide a magnetic toner capable of suppressing reductions in image quality and developability, the tailing of a fixed image, a photosensitive member flaw, and the scattering of the magnetic toner in a machine and of achieving a low toner consumption even when it is used in a large-capacity process cartridge with an increased process speed or an increased toner loading weight in an developing unit.

The inventors of the present invention have made extensive studies to find the following. The use of a magnetic toner including at least: a binder resin; and a magnetic body, in which, when magnetization at a magnetic field strength of 397.9 kA/m and a coercive force of the magnetic toner are denoted by $\sigma s$ ($Am^2/kg$) and Hc (kA/m), respectively, a magnetic field strength at which the magnetic toner shows a magnetization value equal to 95% of $\sigma s$ is denoted by H95% (kA/m), and a number average particle size of the magnetic body is denoted by d (μm), H95%, Hc, and d satisfy the following expressions, can achieve the object of the present invention. Thus, the inventors have completed the present invention.

$$151<H95\%<200 \quad (1)$$

$$7.1<Hc<12 \quad (2)$$

$$40<Hc/d<150 \quad (3)$$

In one preferred aspect of the magnetic toner of the present invention, the number average particle size d of the magnetic body is 0.08 to 0.19 μm.

In another preferred aspect of the magnetic toner of the present invention, when a magnetic field strength at which the magnetic toner shows a magnetization value equal to 90% of $\sigma s$ is denoted by H90% (kA/m), H90% satisfies the following expression.

$$111<H90\%<140 \quad (4)$$

Further, in another preferred aspect of the magnetic toner of the present invention when residual magnetization of the magnetic toner is denoted by $\sigma r$ ($Am^2/kg$), $\sigma s$ and $\sigma r$ satisfy the following expression.

$$7.0<\sigma s/\sigma r<16.0 \quad (5)$$

The magnetic toner of the present invention is capable of suppressing the scattering of the toner to the periphery of a letter, fogging, the acceleration of roughness, the occurrence of a photosensitive member flaw, and the scattering of the magnetic toner in a machine even when it is used in a large-capacity process cartridge with an increased process speed or an increased toner loading weight in an developing unit. In addition, the magnetic toner is excellent in fine-line reproducibility, and can achieve a low toner consumption.

DETAILED DESCRIPTION OF THE PREFERRED EMBODIMENTS

<1> Magnetic Toner

Figure 1:
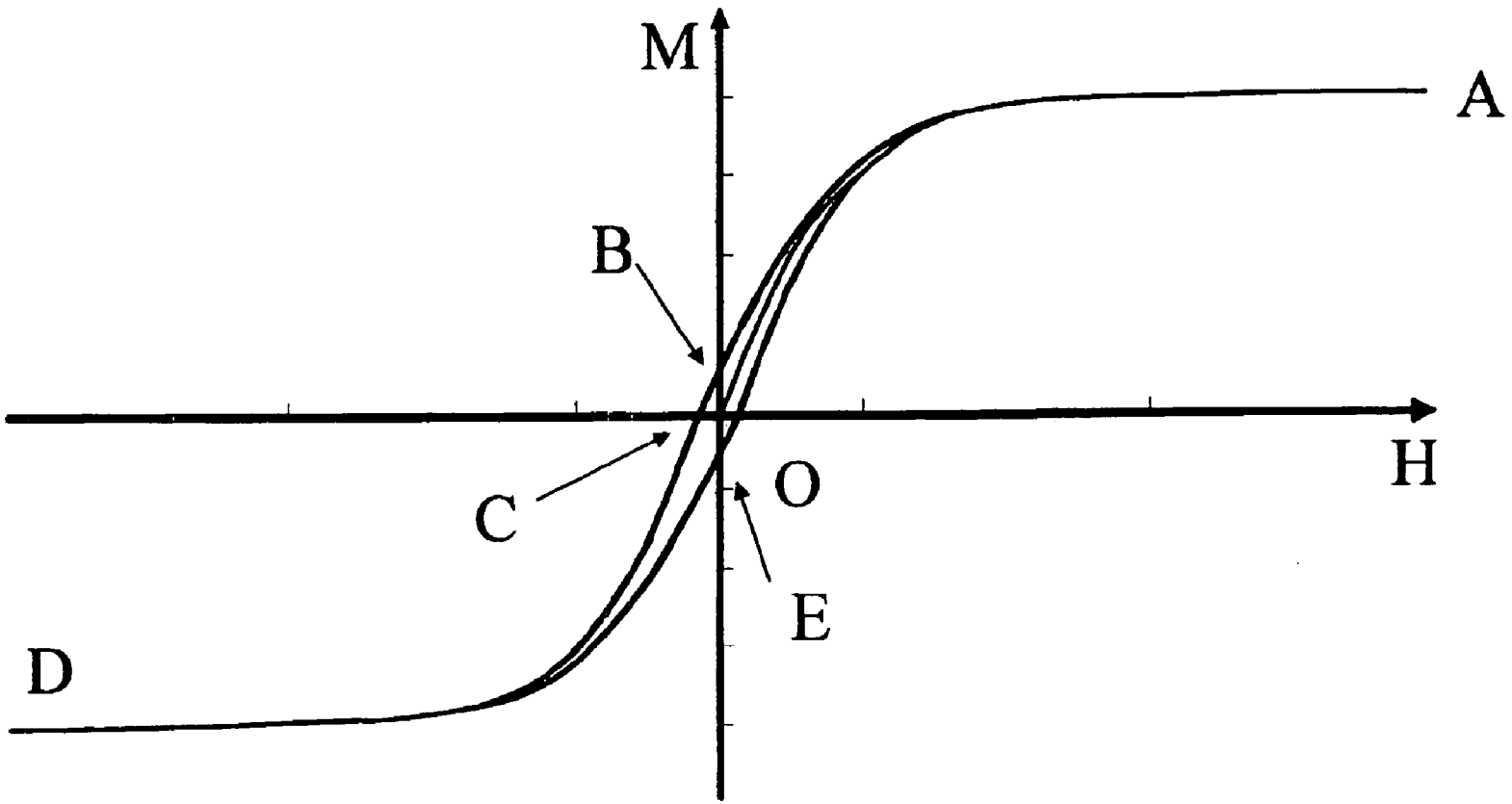
FIG. 1 shows an example of a hysteresis loop.

The magnetic toner of the present invention shows specific magnetic properties.

More specifically, in the magnetic toner of the present invention, when magnetization at a magnetic field strength of 397.9 kA/m and a coercive force of the magnetic toner are denoted by $\sigma s$ ($Am^2/kg$) and Hc (kA/m), respectively, a magnetic field strength at which the magnetic toner shows a magnetization value equal to 95% of $\sigma s$ is denoted by H95% (kA/m), and a number average particle size of the magnetic body is denoted by d (μm), H95%, Hc, and d satisfy the following expressions.

$$151<H95\%<200 \quad (1)$$

$$7.1<Hc<12 \quad (2)$$

$$40<Hc/d<150 \quad (3)$$

The magnetic properties of the magnetic toner and the magnetic body can be measured by means of a magnetometer such as an "oscillation sample type magnetometer VSM-3S-15" (manufactured by Toei Industry Co., Ltd.).

The values for the magnetic properties in the present invention are values measured under environment conditions including a temperature of 22.5° C. and a humidity of 50% RH.

In jumping development mode, in a space between a magnetic toner bearing member (developing sleeve) as a charge imparting member and a photosensitive member (developing nip portion), magnetic toner receives the action of an electric field due to a voltage for causing the toner to fly to the photosensitive member and a voltage in a direction of pulling back the toner, a magnetic attracting force due to the magnetic restraint force of the magnetic toner bearing member, and a magnetic attracting force between magnetic toner particles and the gravity of the magnetic toner, so magnetic toner particles to reach the photosensitive member are sieved on the basis of a tradeoff relationship among the above forces.

The magnetic toner that has formed napping on the magnetic toner bearing member generally passes through the developing nip while maintaining a nap shape to some extent.

At this time, in the case where the nap shape is thick and long, a toner mounting height on the photosensitive member increases, so the tailing of a fixed image is apt to be remarkable. As a result, fine-line reproducibility is apt to reduce, or a toner consumption is apt to increase. In particular, when transfer residual toner also has a certain degree of mounting height, a photosensitive member flaw is apt to occur owing to rubbing with a cleaning blade. On the magnetic toner bearing member, the magnetic toner inside the nap is not sufficiently charged, so detrimental effects on an image such as fogging due to insufficient charging, and scattering and roughness due to the development of a thick nap are apt to occur.

In contrast, in the case where the magnetic toner at the developing nip portion forms nearly no nap shape or partially forms a nap owing to a weak magnetic attracting force, a toner mounting amount on the photosensitive member reduces, so the case may be advantageous for the suppression of the tailing of a fixed image and a toner consumption. However, in particular, for example, in the case where a process speed increases or the charge amount distribution of the toner expands after long-term duration using a large-capacity cartridge, the deterioration of image quality such as fogging due to charged-up toner, a reduction in fine-line reproducibility, or roughness is apt to occur unless a magnetic restriction between magnetic toner particles due to the formation of an appropriate nap shape is exerted.

The inventors of the present invention have made studies through the direct observation of the development behavior of the magnetic toner in such developing nip portion as described above. As a result, they have found that magnetic toner provided with specific magnetic properties exhibits a development form suitable for achieving the object of the present invention. At first, the inventors of the present invention have found that it is important to control not only more macroscopic magnetic properties of the magnetic toner such as magnetization ($\sigma s$) and residual magnetization obtained from a hysteresis loop but also the gradient of a magnetization curve indicated by a value for H95% in achieving the object of the present invention. To be specific, the inventors have found that it is important to control the value for H95% to fall within the range of the expression (1). In addition, the inventors have found that the value for H95% can be controlled to fall within the range of the expression (1) by additionally uniformizing the magnetic properties of an individual magnetic toner particle. Furthermore, the inventors have found that, when the value for Hc and the number average particle size of the magnetic body are controlled in addition to the value for H95%, naps of a uniform size are formed on the magnetic toner bearing member, so development is performed while nap shapes which are relatively thin and short, and are of a uniform size are maintained even at the developing nip portion.

FIG. 1 shows an M-H curve (hysteresis loop) showing a relationship between a magnetic field (H) and the magnitude of the magnetization (M) of an entire magnetic body when the magnetic field is applied to the magnetic body. An initial state before the application of H is 0, and the state with H=0 and M=0 is referred to as a demagnetized state. M increases as H is applied, and reaches saturation (A). The rise-up curve is referred to as an initial magnetization curve, and the magnetization reaching saturation is "magnetization ($\sigma s$)". The ratio of an increase in magnetization upon application of a magnetic field is referred to as magnetic susceptibility. M does not return to 0 even when H is reduced from the saturated stated, and reaches a state B with H=0. As a result, magnetization corresponding to the length of the line segment OB remains. The remaining magnetization is referred to as residual magnetization ($\sigma r$). When the magnetic field strength in an opposite direction is increased, M reduces to C. The magnetic field corresponding to the length of the line segment OC is referred to as a coercive force (Hc). Furthermore, when a negative magnetic field is increased, M reaches D to saturate in an opposite direction. When a positive magnetic field is increased again, M reaches A via E. Thus, such hysteresis loop as shown in the figure is drawn.

In the present invention, the residual magnetization ($\sigma r$) and the coercive force (Hc) were determined by depicting a hysteresis loop when a maximum applied magnetic field is set at 397.9 kA/m as shown in FIG. 1.

Figure 2:
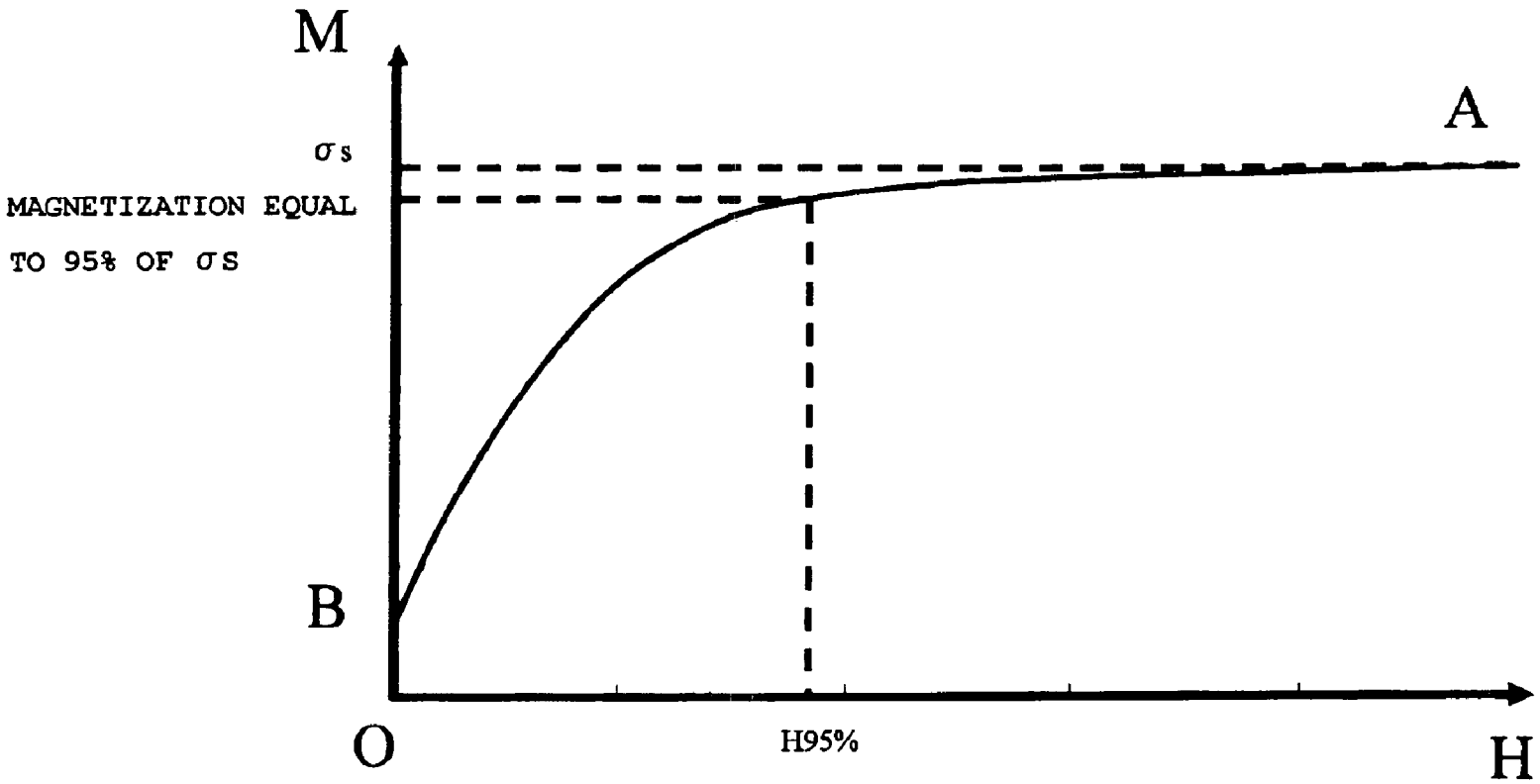
FIG. 2 shows an example of a hysteresis loop (enlarged view).

The magnetization reaches the saturation magnetization via the initial magnetization curve. After that, H is reduced for demagnetization. As shown in FIG. 2, H95% represents the magnetic field strength at which the magnetization shows a magnetization value equal to 95% of the magnetization ($\sigma s$). In the same manner, H90% (not shown) represents the magnetic field strength at which the magnetization shows a magnetization value equal to 90% of the magnetization ($\sigma s$).

In addition, in the magnetic toner of the present invention, more preferably, when a magnetic field strength at which the magnetic toner shows a magnetization value equal to 90% of $\sigma s$ is denoted by H90% (kA/m), H90% satisfies the expression (4).

$$111 < H90\% < 140 \quad (4)$$

In the magnetic toner of the present invention, H95% is in the range of the expression (1) (more preferably, H90% is in the range of the expression (4)), so the gradient of a demagnetization course portion (A-B) of the hysteresis loop is relatively steep in a low magnetic field as compared to the magnetic properties of general magnetic toner. That is, when H is reduced after the saturation of the magnetization, demagnetization hardly occurs in a high magnetic field, so a magnetization value does not reduce unless a magnetic field strength is reduced to a low magnetic field.

In the entirety of the magnetic toner, the magnetic properties of the respective magnetic toner particles differ from each other, so the magnetic properties are probably distributed to different magnetic property values. Such magnetic property distribution is expected to occur owing to, for example, a large difference in magnetic body amount between the respective magnetic toner particles or the nonuniformity of the magnetic properties of the magnetic body particles themselves. When the distribution is wide, H95% and H90% tend to be relatively high, so an effect intended by the present invention is hardly obtained.

The value for H95% is apt to be large when the magnetic properties of the magnetic toner particles are nonuniform. In particular, in the case of a magnetic field strength of 200 kA/m or more, nap shapes which are thick and are not of a uniform size are apt to be formed, so such detrimental effects on an image as described above are apt to occur. In addition, when the magnetic properties of the magnetic toner particles are nonuniform, the magnetic properties of the respective toner particles largely differ from each other even when the dispersibility of the magnetic body into the toner is improved, with the result that a problem such as fogging is apt to be remarkable. It should be noted that H95% is more preferably smaller than 190, or still more preferably smaller than 185.

On the other hand, when the value for H95% is equal to or smaller than 151, Hc tends to be small at the same time. Hc can be increased by controlling composition in such a manner that as increases. However, an increase in σs is not preferable because a magnetic cohesive force increases, so a nap is apt to be thick and good dispersion into toner is hardly achieved. It should be noted that H95% is more preferably larger than 153, or still more preferably larger than 155.

When Hc is low (equal to or lower than 7.1) in the absence of σs of a sufficient magnitude, a magnetic restraint force between magnetic toner particles or between the magnetic toner and the magnetic toner bearing member is insufficient, so a nap is hardly formed. In addition, part of the toner particles are apt to undergo demagnetization between developing nips. Therefore, the magnetic toner that has reached the photosensitive member once is not pulled back by a magnetic attracting force, so fogging, scattering, or the like is apt to be remarkable. In addition, the magnetic toner bearing member is coated with the toner owing to a magnetic force, so a force for conveying toner to the magnetic toner bearing member reduces depending on the environment where a machine is used, a durability test, and the like. As a result, detrimental effects on an image such as a reduction in image density and density unevenness due to insufficient coating may occur. In addition, the machine is apt to be contaminated owing to the scattering of the toner in the machine. Hc is more preferably larger than 7.2, or still more preferably larger than 7.3.

On the other hand, when Hc is large (equal to or larger than 12), such problems as described above due to an increase in magnetic cohesive force are apt to occur. In addition, a magnetic restraint force by the magnetic toner bearing member is strong, so a reduction in image density is apt to occur.

In addition, it is preferable that a nap that has reached the photosensitive member be deformed and magnetic toner be faithfully rearranged for a latent image. In the case where Hc is equal to or larger than 12, the rearrangement is hardly performed owing to a magnetic restraint force by the magnetic toner bearing member, so a long nap shape is apt to be maintained as it is. As a result, for example, the tailing of a fixed image is apt to be remarkable, fine-line reproducibility is apt to deteriorate, and a photosensitive member flaw is apt to be remarkable. Hc is more preferably smaller than 11.5, or still more preferably smaller than 11.2.

Furthermore, it is important for Hc and the number average particle sized of the magnetic body to satisfy the expression (3) in order that the magnetic toner may exert an effect of the present invention.

When a value for Hc/d is equal to or smaller than 40, a coercive force per unit length in the magnetic body reduces. Accordingly, a magnetic restraint force may be insufficient even when the value for Hc is in the range of the expression (2), with the result that detrimental effects on an image such as fogging and scattering are apt to occur. The value for Hc/d is more preferably larger than 42, or still more preferably larger than 44.

On the other hand, when the value for Hc/d is equal to or larger than 150, a magnetic restraint force or a magnetic cohesive force tends to be strong, so such problems as described above are apt to occur. The value for Hc/d is more preferably smaller than 140, or still more preferably smaller than 130.

In addition, in the magnetic toner according to the present invention, when residual magnetization of the magnetic toner is denoted by σr ($Am^2/kg$), σs and σr further preferably satisfy the expression (5).

$$7.0<\sigma s/\sigma r<16.0 \quad (5)$$

When a value for σs/σr is equal to or smaller than 7.0, the magnetic cohesive force of the magnetic body tends to be strong, so such problems as described above are apt to occur. Therefore, the value is more preferably larger than 7.2, or still more preferably larger than 7.5. In contrast, when the value for σs/σr is equal to or larger than 16.0, a magnetic restraint force tends to be weak, so such problems as described above are apt to occur. Therefore, the value is more preferably smaller than 15.5, or still more preferably smaller than 15.0. Furthermore the, σs is preferably 20 to 60 $Am^2/kg$, and is more preferably 25 to 50 $Am^2/kg$. σr is preferably 1.8 to 8.5 $Am^2/kg$, and is more preferably 2.2 to 6.0 $Am^2/kg$.

The magnetic toner of the present invention have such magnetic properties as described above. The magnetic properties of the magnetic body in the magnetic toner can be generally adjusted depending on, for example, the kind and number average particle size of the magnetic body, and the kind and combination amount of a non-magnetic body with which the magnetic body is blended. In particular, as described in detail later, each of the magnetic properties of the magnetic toner of the present invention can be adjusted to fall within a specific range by: controlling the number average particle size, particle size distribution, and surface property of the magnetic body to uniformize the magnetic properties of the respective magnetic body particles; and uniformly dispersing the particles into the magnetic toner.

<2> Method of Producing Magnetic Toner

The effect of the present invention can be exerted because the magnetic property distribution in the respective magnetic toner particles can be additionally uniformized by uniformizing the magnetic properties of the magnetic body and by improving the dispersibility of the magnetic body into the magnetic toner. Specific examples of means for uniformizing the magnetic properties of the magnetic body and means for improving dispersibility include: the setting of each of the number average particle size and particle size distribution of the magnetic body such that each of them falls within such specific range as described below; the control of the property of the surface of a magnetic body particle; and an idea in the production process for magnetic toner.

The magnetic body can be evaluated for dispersibility into the magnetic toner by means of, for example, such procedure as described below.

At first, the weight average particle size and true density of the magnetic toner are denoted by D4 and d1, respectively. For example, data measured by means of a dry automatic densimeter "Accupyc 1330" manufactured by Shimadzu Corporation can be used for the true density. The magnetic toner is classified by means of known classifying means. At this time, the classifying means is operated in such a manner that the weight average particle size of the magnetic toner after the classification is a times as large as D4 by removing particles of coarse powder region. The true density d2 of the magnetic toner obtained after the classification is measured, and a ratio d2/d1 of d2 to d1 is calculated. Thus, the dispersibility of the magnetic body into the magnetic toner can be grasped. A value for a can be appropriately determined. In the present invention, a classification operation was performed in such a manner that the weight average particle size of the magnetic toner after the classification would be 0.7 time as large as D4. It can be judged that better dispersibility is achieved as a value for d2/d1 is closer to 1.

In the magnetic toner of the present invention, d2/d1 is preferably 0.975 or more, or more preferably 0.980 or more.

(1) Method of Producing Magnetic Body

A method of producing the magnetic body to be used in the magnetic toner of the present invention will be described.

The number average particle size of the magnetic body to be incorporated into the magnetic toner of the present invention is preferably 0.08 to 0.19 μm in terms of, for example, dispersibility, blackness, and magnetic properties, and is more preferably 0.09 to 0.18 μm, or still more preferably 0.10 to 0.17 μm. A number average particle size of less than 0.08 μm is not preferable because insufficient dispersion due to, for example, the reagglomeration of the magnetic body in the magnetic toner occurs or blackness reduces in some cases. An average particle size in excess of 0.19 μm is not preferable either because the average particle size may be responsible for insufficient dispersion into the magnetic toner, and the magnetic properties of the respective toner particles are apt to differ from each other largely, so a problem such as fogging is apt to be remarkable although the average particle size is advantageous for blackness.

Here, the number average particle size of the magnetic body particles can be determined by: selecting 300 particles on a transmission electron micrograph (at a magnification of 30,000) at random; measuring the particle size of each of the particles; and calculating the average value of the particle sizes which corresponds to the number average particle size. In general, the average particle size of the magnetic body can be adjusted by, for example, controlling an initial alkali concentration or the process of particle production by an oxidation reaction.

In general, there also arises a problem, that is, the deterioration of blackness when the particle size of the magnetic body is reduced. It has been conventionally known that the blackness of the magnetic body depends on the content of FeO (or $Fe^{2+}$). However, the FeO content in the magnetic body reduces as deterioration with time due to oxidation after production proceeds, with the result that a phenomenon referred to as the deterioration of blackness occurs. It is needless to say that the deterioration with time largely depends on the environment where the magnetic body is placed. The deterioration is also accelerated by reducing the particle size of the magnetic body. The magnetic body with a reduced particle size is susceptible to heat as well as change with time. Even a magnetic body having high blackness is oxidized depending on its particle size and the temperature applied to the magnetic body at the time of toner production, with the result that the magnetic toner may finally look reddish.

It has been also known that a reduction in FeO content causes not only the deterioration of blackness but also reductions in magnetic properties. Even when the magnetic body has a certain degree of number average particle size, in the case where the particle size distribution of the magnetic body particles is wide and the magnetic body contains many fine particles, an FeO content is apt to reduce in a magnetic body particle with a reduced size. Accordingly, even when the blackness of the entirety of the magnetic body is not problematic, the magnetic properties of the respective magnetic body particles are apt to be additionally nonuniform, with the result that such problems as described above are apt to occur.

The inventors of the present invention have found that the formation of a high-density oxide coating layer by means of a method to be described later is extremely effective for problems, that is, a change in magnetic property distribution and the deterioration of blackness in association with a reduction in FeO content of the magnetic body.

The term "high-density oxide coating layer" as used herein refers to such coating layer as described below: the surface of a magnetic body is substantially completely coated with an oxide of the magnetic body, and surface property is substantially identical to the property of the coating oxide. The surface property can be grasped by measuring an isoelectric point.

For example, in the case of an $SiO_2$ coating layer, a high-density $SiO_2$ coating layer is formed by means of a specific method to be described later on the surface of a magnetic body particle, and the isoelectric point of a magnetic body is adjusted to a pH of 4 or less, preferably a pH of 3.5 or less, or more preferably a pH of 3.0 or less.

An oxide with which a high-density coating layer is formed may be $TiO_2$ or $Al_2O_3$ instead of $SiO_2$. Each of them may be used alone for the coating, or two or more kinds of oxides may be used in combination for the coating. When a coating layer is formed of $TiO_2$ alone out of the oxides, an isoelectric point is adjusted to a pH of 4.1 to 8.0, or preferably a pH of 4.5 to 6.5. When a coating layer is formed of $Al_2O_3$ alone, an isoelectric point is adjusted to a pH of 6.1 to 10.0, or preferably a pH of 6.5 to 9.5. Thus, a high-density oxide coating layer can be formed.

The surface of a maternal magnetic body particle can be smoothly and densely coated with a high-density $SiO_2$ layer by means of, for example, the following method.

At first, the temperature of an aqueous suspension containing a magnetic body at a concentration of 50 to 200 g/l is held at 60 to 80° C. An aqueous solution of sodium hydroxide is added to the aqueous suspension to adjust the pH of the aqueous suspension to 9.0 or more. An amount equivalent to 0.1 to 10.0 mass % in terms of $SiO_2/Fe_3O_4$ of an aqueous solution of sodium silicate is added to the aqueous suspension while the aqueous suspension is stirred. Next, dilute sulfuric acid is added to reduce the pH of the aqueous suspension gradually. Finally, the pH of the aqueous suspension is brought into a neutral-to-acid region over about 4 hours. As a result, the contents in the aqueous suspension while an aqueous suspension is stirred can be easily agglomerated and precipitated. A known organic/inorganic agglomerate reagent may be added as required. The resultant is washed, filtered, dried, and shredded to produce a magnetic body coated with $SiO_2$.

A high-density $TiO_2$ coating layer or $Al_2O_3$ coating layer can be formed of $TiO_2$ or $Al_2O_3$ in the same manner by adding $TiO_2$ or $Al_2O_3$ to the aqueous suspension while an aqueous suspension is stirred at around the pH at which $TiO_2$ or $Al_2O_3$ shows high solubility.

In addition, in particular, as described later, an oxide coating layer can be caused to adhere strongly to a maternal magnetic body particle before the formation of a coating layer by: incorporating Si into the particle; and adding a fine pore structure to the surface of the particle.

When a maternal magnetic body contains Si, in particular, arranging a coating layer formed of $SiO_2$ facilitates the formation of an oxide coating layer with an improved strength and an increased density probably because of a large action of a siloxane bond between Si atoms between the surface of the maternal magnetic body and the coating layer or in the coating layer.

In the present invention, an $SiO_2$ content upon formation of, for example, a high-density $SiO_2$ coating layer by means of a method to be described later is preferably 0.8 to 20 mass %, or more preferably 1.0 to 5.0 mass % with respect to the total mass of the magnetic body.

Here, when the $SiO_2$ content in the surface of the magnetic body is less than 0.8 mass % with respect to the total mass of the magnetic body, the surface of a magnetic body particle cannot be uniformly and sufficiently coated with $SiO_2$. Accordingly, when such magnetic body is used for magnetic toner, the charging stability of the magnetic toner is apt to reduce, and effects such as dispersibility into the magnetic toner, an improvement in fluidity due to agglomeration, and the maintenance of blackness are hardly achieved. On the other hand, when the $SiO_2$ content exceeds 20 mass %, the charge amount of magnetic toner is so high that a reduction in image density due to charge-up and the acceleration of fogging are apt to occur.

The isoelectric point of a magnetic body can be measured by means of, for example, the following method.

At first, the magnetic body is dissolved or dispersed into ion-exchanged water at 25° C., and a sample concentration is adjusted to 1.8 mass %. The resultant is titrated with 1N HCl, and the zeta potential of the resultant is measured by means of an ultrasonic zeta potential measuring device DT-1200 (manufactured by Dispersion Technology). The pH at which the zeta potential is 0 mV is defined as an isoelectric point.

The presence of an oxide coating layer on the surface of the magnetic body can alleviate insufficient fluidity due to agglomeration which is problematic in a magnetic body particle having a small particle size. In addition, the presence of an oxide layer formed of a non-magnetic inorganic compound on the surface of a magnetic body particle increases the electrical resistance value of the magnetic toner, and facilitates the maintenance of a high charge amount irrespective of an environment.

The oxide content in the magnetic body can be measured by performing fluorescent X-ray analysis in accordance with JIS K0119 "Fluorescent X-ray analysis ordinary rules" by means of, for example, a fluorescent X-ray analyzer SYSTEM 3080 (manufactured by Rigaku Corporation).

A method of producing a magnetic body having such constitution as described above to be used in the present invention will be described.

Hereinafter, a magnetic body having no coating layer (before the formation of a coating layer) is represented as a "maternal magnetic body" so that it can be distinguished from a magnetic body having a coating layer. That is, the magnetic body to be used in the present invention may be composed only of a maternal magnetic body adjusted to specific magnetic properties so that the effect of the present invention can be exerted, or may be a magnetic body obtained by forming a coating layer on the surface of a maternal magnetic body adjusted to specific magnetic properties. As described above, the latter, that is, a magnetic body having a coating layer is preferable for the present invention.

Examples of an available raw material for the maternal magnetic body in the present invention include magnetic iron oxides containing heteroelements such as magnetite, maghemite, and ferrite, and a mixture of them. The maternal magnetic body is preferably mainly composed of magnetite having a high FeO content. Magnetite particles can be generally obtained by oxidizing ferrous hydroxide slurry prepared by neutralization mixing of an aqueous solution of ferrous salt and an alkali solution.

In addition, the maternal magnetic body to be used in the present invention more preferably contains an Si element as a heteroelement. An Si element is preferably present both of: in the maternal magnetic body; and on the surface of the material. In the production process for the maternal magnetic body, an Si element is more preferably caused to be preferentially present on the surface by adding the Si element in a stepwise manner. When the surface of the maternal magnetic body contains an Si element, a large number of fine pores can be easily formed in the surface. Accordingly, upon formation of an oxide coating layer on the outer shell of the material, a coating layer with improved denseness can be formed while its adhesive force with the surface of the maternal magnetic body is improved.

An Si element content is preferably 0.1 to 3.0 mass %, or more preferably 0.1 to 2.0 mass % with respect to an Fe element in the maternal magnetic body. When the Si element content is less than 0.1 mass %, the adhesive force of the surface of the maternal magnetic body with the coating layer is apt to be insufficient. On the other hand, when the content exceeds 3.0 mass %, the denseness of the oxide coating layer to be formed on the surface is apt to be impaired, and the smoothness of the magnetic body after coating is apt to be lost.

On the other hand, the maternal magnetic body to be used in the present invention preferably has a small total content of Al, P, S, Cr, Mn, Co, Ni, Cu, Zn, and Mg. The above components are often added intentionally depending on a target effect; provided that the above components are often present as inevitable components derived from raw materials at the time of production of the magnetic body. A reduced total content of the above components in the magnetic body to be used in the present invention easily provides a magnetic body having magnetic properties with which the effect of the present invention is exerted. The total content is preferably 1 mass % or less, or more preferably 0.8 mass % or less with respect to an Fe element in the maternal magnetic body.

The maternal magnetic body can be produced by means of a known method of producing a magnetic body using the above-described raw materials for the maternal magnetic body. In addition, a maternal magnetic body the surface of which has an Si element preferentially present thereon, the maternal magnetic body being preferable in the present invention, can be produced by means of, for example, the following method.

An aqueous solution of ferrous salt and 0.90 to 0.99 equivalent of an aqueous solution of alkali hydroxide with respect to $Fe^{2+}$ in the aqueous solution of ferrous salt are allowed to react with each other to prepare a reacted aqueous solution of ferrous salt containing a ferrous hydroxide colloid. An oxygen-containing gas is introduced into the reacted aqueous solution of ferrous salt so that magnetic body particles are produced. Here, 50 to 99% of the total content (0.1 to 3.0 mass %) of water-soluble silicate in terms of an Si element with respect to an iron element is added in advance to one of the aqueous solution of alkali hydroxide and the reacted aqueous solution of ferrous salt containing a ferrous hydroxide colloid. An oxygen-containing gas is introduced into the resultant for causing an oxidation reaction while the resultant is heated in the temperature range of 85 to 100° C., thereby causing the ferrous hydroxide colloid to generate magnetic iron oxide particles containing an Si element. After that, 1.00 equivalent or more of an aqueous solution of alkali hydroxide with respect to $Fe^{2+}$ remaining in the suspension after the completion of the oxidation reaction and the residue of the water-soluble silicate [1 to 50% of the total content (0.4 to 2.0 mass %)] are added, and the whole is subjected to an oxidation reaction while being heated in the temperature range of 85 to 100° C. Thus, a magnetic body containing an Si element is produced. Next, the resultant is filtered, washed with water, dried, and shredded according to a known method to produce the maternal magnetic body according to the present invention.

Examples of $SiO_2$ to be added to the maternal magnetic body to be used in the present invention include: silicates such as commercially available soda silicate; and silicic acid such as sol-like silicic acid produced by hydrolysis or the like.

Examples of an available ferrous salt include: iron sulfate as a general by-product in the production of titanium according to a sulfuric acid method; and iron sulfate as a by-product in the surface washing of a steel plate. Iron chloride or the like is also available.

According to the production method described above, a magnetic body can be produced, which is mainly composed of spherical particles each formed of a curved surface having no plate-like surface, and which is nearly free from octahedral particles in the observation with a transmission electron micrograph. Such magnetic body is preferably used for magnetic toner.

In the present invention, in order that the respective magnetic body particles may have uniform magnetic properties and a coating layer formed of an oxide may be formed with improved uniformity, a fine powder and a coarse powder are preferably removed by classifying the maternal magnetic body thus obtained by means of, for example, air classification. 300 particles on the transmission electron micrograph (at a magnification of 30,000) of the magnetic body obtained as a result of classification are selected at random, the particle size of each of the particles is measured, and a standard deviation is calculated. A value for the standard deviation is preferably 0.050 μm or less for obtaining the magnetic properties intended by the present invention. More preferably, a classification operation is performed in such a manner that the value is 0.045 μm or less (still more preferably 0.040 μm or less).

Examples of a classifier that can be used for removing fine and coarse powders from the magnetic body particles include dry classifiers including, but not limited to, an Elbow jet (manufactured by Nittetsu Mining Co., Ltd.), a Fine Sharp separator (manufactured by Hosokawa Micron Corporation), a Variable Impactor (manufactured by SANKYO DENGYO Corporation), a Spedic classifier (manufactured by Seishin Enterprise Co., Ltd.), a Donaselec (manufactured by NIPPON DONALDSON, LTD.), a YM microcut (manufactured by Yasukawa Shoji), and various air separators, micron separators, microprexes, and accucuts. Wet classifiers are also sufficiently available. For example, a cylindrical centrifugal separator or a disk centrifugal separator is also available. The magnetic body of the present invention can be produced through one or multiple classifying steps by means of each of those classifiers alone or an individual combination of two or more of them in the present invention.

However, when a biased classification operation is performed in the step of classifying the magnetic body particles, the magnetic toner having magnetic properties intended by the present invention cannot be obtained in some cases. Although the reason for this is unclear, the inventors consider that a coarse powder side in the particle size distribution of the magnetic body particles and a fine powder side in the distribution differ from each other in magnetic properties, powder physical properties, and the like. In addition, a biased classification operation is not preferable in view of the foregoing because a production yield may reduce.

In the present invention, the maternal magnetic body or magnetic body coated with an oxide obtained by means of the above method is preferably compressed, sheared, or squeezed with a spatula by means of a mix maller, an automated mortar, or the like so that the magnetic properties, surface area, and smoothness of such magnetic body are adjusted. In particular, performing such compression treatment after a treatment for coating with an oxide enables a share to be uniformly applied to a magnetic body particle because the fluidity of the magnetic body particle is improved and the aggregability of the particle reduces. Accordingly, a magnetic body showing magnetic properties with which the effect of the present invention can be exerted and good dispersibility into toner can be easily obtained. In addition, at the same time, an oxide coating layer can be caused to adhere with an improved strength.

More preferably, a shredding treatment is performed after the compression treatment to disentangle magnetic body particles. Thus, additionally good dispersibility into toner can be achieved.

The magnetization in a magnetic field of 397.9 kA/m and residual magnetization of the magnetic body to be used in the present invention before a surface treatment are denoted by Ms and Mr, respectively. A value for Ms is preferably 50 to 150 $Am^2/kg$, more preferably 70 to 100 $Am^2/kg$, or still more preferably 80 to 90 $Am^2/kg$. On the other hand, a value for Mr is preferably 1.0 to 20.0 $Am^2/kg$, more preferably 2.0 to 15.0 $Am^2/kg$), or still more preferably 4.0 to 12.0 $Am^2/kg$.

(2) Method of Producing Magnetic Toner

Furthermore, the constitution of the magnetic toner of the present invention will be described in detail below.

Respective values for σs and σr of magnetic toner vary depending on the number of parts of a magnetic body to be added. The number of parts of a magnetic body to be added to the magnetic toner particles of the present invention is preferably 30 to 150 parts by mass, more preferably 35 to 140 parts by mass, still more preferably 40 to 130 parts by mass, or particularly preferably 70 to 120 parts by mass with respect to 100 parts by mass of a binder resin in terms of dispersibility, an image density, image quality, a consumption, and the like.

Any one of various resin compounds that have been conventionally known as binder resins can be used as a binder resin to be used in the present invention. Examples of the binder resin include a vinyl-based resin, a phenol resin, a natural resin-modified phenol resin, a natural resin-modified maleic acid resin, an acrylic resin, a methacrylic resin, polyvinyl acetate, a silicone resin, a polyester resin, polyurethane, a polyamide resin, a furan resin, an epoxy resin, a xylene resin, polyvinyl butyral, a terpene resin, a coumarone-indene resin, and a petroleum-based resin. Each of the binder resins may be used alone, or two or more of them may be used in combination.

The binder resin in the present invention preferably has an acid value of preferably 1 to 50 mgKOH/g, or more preferably 2 to 40 mgKOH/g.

The reason for this is as follows. When the binder resin has an acid value of less than 1 mgKOH/g or in excess of 50 mgKOH/g, it becomes difficult to control the amount of moisture adsorbed to the magnetic toner. In addition, an environmental fluctuation of the chargeability of the magnetic toner tends to be large.

In addition, the binder resin has an OH value (hydroxyl value) of preferably 60 mgKOH/g or less, or more preferably 45 mgKOH/g or less. The reason for this is as follows. Dependence of the charging property of the magnetic toner on the environment increases with increasing number of terminal groups in a molecular chain. As a result, the fluidity, electrostatic adherence, and developer surface resistance (influence of adsorbed water) of the magnetic toner fluctuate, which may be responsible for a reduction in image quality.

The acid value of a binder resin can be determined through the following operations 1) to 5), for example. The basic operations belong to JIS K0070.

1) An additive except the binder resin (polymer component) is removed before a sample is used. Alternatively, the content of the components of the sample except the binder resin is determined. 0.5 to 2.0 g of a pulverized product of magnetic toner or of the binder resin are precisely weighed. The mass of the binder resin component at this time is denoted by W (g).

2) The sample is placed into a 300-ml beaker, and 150 ml of a mixed solution of toluene and ethanol (4:1) are added to dissolve the sample.

3) Measurement is performed by means of a 0.1-mol/l solution of KOH in ethanol and a potentiometric titration apparatus. For example, automatic titration using a potentiometric titration apparatus AT-400 (winworkstation) manufactured by Kyoto Denshi and an ABP-410 electrically-driven buret can be used for the titration.

4) The usage of the KOH solution at this time is denoted by S (ml). A blank is measured at the same time, and the usage of the KOH solution at this time is denoted by B (ml).

5) The acid value is calculated from the following equation. It should be noted that "f" in the following equation denotes the factor of KOH.

$$\text{Acid value(mgKOH/g)}=\{(S-B)\times f\times 5.61\}/W$$

An OH value can be determined through the following operations 1) to 8), for example. The basic operations belong to JIS K0070.

1) An additive except the binder resin (polymer component) is removed before a sample is used. Alternatively, the content of the components of the sample except the binder resin is determined. 0.5 to 2.0 g of a pulverized product of magnetic toner or of the binder resin are precisely weighed and placed into a 200-ml flat-bottomed flask.

2) 5 ml of an acetylating reagent (prepared by: placing a total of 25 g of acetic anhydride into a 100-ml flask; adding pyridine to have a total amount of 100 ml; and sufficiently stirring the mixture) are added to the flat-bottomed flask. When the sample is hardly dissolved, a small amount of pyridine is added, or xylene or toluene is added to dissolve the sample.

3) A small funnel is placed on the port of the flask. Then, a portion of the flask up to a height of about 1 cm from the bottom is immersed into a glycerin bath at a temperature of 95 to 100° C. for heating. A circular plate of cardboard with a circular hole at its center is covered on the base of the neck of the flask in order to prevent the temperature of the neck of the flask from increasing owing to heat from the glycerin bath.

4) 1 hour after that, the flask is taken out of the glycerin bath and left standing to cool. After that, 1 ml of water is added through the funnel, and the flask is shaken to decompose acetic anhydride.

5) The flask is heated in the glycerin bath again for an additional 10 minutes to complete the decomposition, and then the flask is left standing to cool. After that, the funnel and the wall of the flask are washed with 5 ml of ethanol.

6) Several droplets of a phenolphthalein solution as an indicator are added, and titration is performed with a 0.5-kmol/m$^3$ solution of potassium hydroxide in ethanol. The endpoint is defined in such a manner that a pale red color of the indicator lasts for about 30 seconds.

7) The operations 2) to 6) are performed as blank examination with no resin added.

8) The OH value is calculated from the following equation.

$$A=[\{(B-C)\times 28.05\times f\}/S]+D$$

(In the equation, A represents a hydroxyl value (mgKOH/g); B, the amount (ml) of the 0.5-kmol/m$^3$ solution of potassium hydroxide in ethanol used for the blank examination; C, the amount (ml) of the 0.5-kmol/m$^3$ solution of potassium hydroxide in ethanol used for the titration; f, the factor of the 0.5-kmol/m$^3$ solution of potassium hydroxide in ethanol; S, the amount (g) of the binder resin in the sample; and D, the acid value of the sample. The value "28.05" in the equation is the formula mass of potassium hydroxide (56.11×½).)

The acid value and hydroxyl value of a binder resin can be adjusted by, for example, the kinds and combination amounts of monomers constituting the binder resin.

An alcohol component preferably accounts for 45 to 55 mol % of all the components of the polyester resin which is preferably used in the present invention, and an acid component preferably accounts for 55 to 45 mol % thereof.

Examples of the alcohol component include: ethylene glycol; propylene glycol; 1,3-butanediol; 1,4-butanediol; 2,3-butanediol; diethylene glycol; triethylene glycol; 1,5-pentanediol; 1,6-hexanediol; neopentyl glycol; 2-ethyl-1,3-hexanediol; hydrogenated bisphenol A; bisphenol derivatives each represented by the following general formula (B); diols each represented by the following general formula (C); and polyhydric alcohols such as glycerin, sorbitol, and sorbitan.

(B)

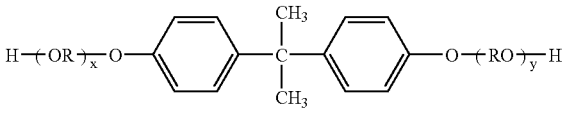

In the general formula (B), R represents an ethylene or propylene group, x and y each represent an integer of 1 or more, and an average value of x+y is 2 to 10.

(C)

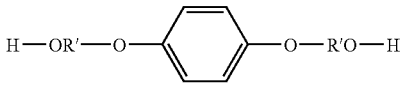

In the general formula (C), R's each represent any one of the following structural formulae, and R's may be identical to or different from each other.

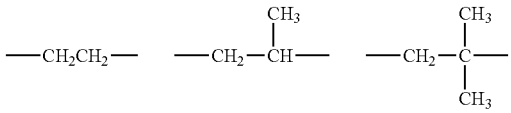

A carboxylic acid can be preferably exemplified as the acid component. Examples of a divalent carboxylic acid include: benzene dicarboxylic acids and anhydrides thereof such as phthalic acid, terephthalic acid, isophthalic acid, and phthalic anhydride; alkyl dicarboxylic acids such as succinic acid, adipic acid, sebacic acid, and azelaic acid, and anhydrides thereof; and unsaturated dicarboxylic acids such as fumaric acid, maleic acid, citraconic acid, and itaconic acid, and anhydrides thereof. Examples of a carboxylic acid which is trivalent or more include trimellitic acid, pyromellitic acid, and benzophenone tetracarboxylic acid, and anhydrides thereof.

Particularly preferable examples of the alcohol component of the polyester resin include the bisphenol derivatives each represented by the formula (B). Particularly preferable examples of the acid component include: dicarboxylic acids (such as phthalic acid, terephthalic acid, and isophthalic acid, and anhydrides thereof, succinic acid and n-dodecenylsuccinic acid, and anhydrides thereof, and fumaric acid, maleic acid, and maleic anhydride); and tricarboxylic acids (such as trimellitic acid and an anhydride thereof). A magnetic toner using a polyester resin prepared from those acid and alcohol components as a binder resin has good fixability and excellent offset resistance.

Any one of the following vinyl-based resins may be used as the binder resin in the magnetic toner of the present invention.

Examples of the vinyl-based resin include polymers using vinyl-based monomers such as: styrene; styrene derivatives such as o-methylstyrene, m-methylstyrene, p-methylenestyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; unsaturated monoolefins such as ethylene, propylene, butylene, and isobutylene; unsaturated polyenes such as butadiene; vinyl halides such as vinyl chloride, vinylidene chloride, vinyl bromide, and vinyl fluoride; vinyl esters such as vinyl acetate, vinyl propionate, and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylic esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; acrylic or methacrylic acid derivatives such as acrylonitrile, methacrylonitrile, and acrylamide; esters of α,β-unsaturated acids; diesters of dibasic acids; acrylic acid and methacrylic acid, and α- or β-alkyl derivatives thereof such as α-ethyl acrylate, crotonic acid, cinnamic acid, vinyl acetate, isocrotonic acid, and angelic acid; unsaturated dicarboxylic acids such as fumaric acid, maleic acid, citraconic acid, alkenylsuccinic acid, itaconic acid, mesaconic acid, dimethylmaleic acid, and dimethylfumaric acid, and monoester derivatives and anhydrides thereof.

The vinyl-based resin described above uses one or two or more of the vinyl-based monomers described above. Of those, a combination of monomers providing a styrene-based copolymer or a styrene-acrylic copolymer is preferable.

The binder resin to be used in the present invention may be a polymer or copolymer cross-linked as required with such cross-linkable monomer as exemplified below.

A monomer having two or more cross-linkable unsaturated bonds can be used as the cross-linkable monomer. Various monomers as shown below have been conventionally known as such cross-linkable monomers, and any one of them can be suitably used for the magnetic toner of the present invention.

Examples of the cross-linkable monomer include: aromatic divinyl compounds such as divinylbenzene and divinylnaphthalene; diacrylate compounds bonded with alkyl chains such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by changing the term "acrylate" in these compounds into "methacrylate"; diacrylate compounds bonded with alkyl chains containing ether bonds such as diethylene glycol diacrylate, triethylene glycol diacrylate, tetraethylene glycol diacrylate, polyethylene glycol #400 diacrylate, polyethylene glycol #600 diacrylate, and dipropylene glycol diacrylate, and compounds obtained by changing the term "acrylate" in these compounds into "methacrylate"; diacrylate compounds bonded with chains containing aromatic groups and ether bonds such as polyoxyethylene (2)-2,2-bis(4-hydroxyphenyl)propane diacrylate and polyoxyethylene(4)-2,2-bis(4-hydroxyphenyl)propane diacrylate, and compounds obtained by changing the term "acrylate" in these compounds into "methacrylate"; and polyester-type diacrylates such as MANDA (Nippon Kayaku Co., Ltd.).

Examples of a polyfunctional cross-linking agent having three or more cross-linkable unsaturated bonds include: pentaerythritol triacrylate, trimethylolethane triacrylate, trimethylolpropane triacrylate, tetramethylolmethane tetraacrylate, and oligoester acrylate, and compounds obtained by changing the term "acrylate" in these compounds into "methacrylate"; triallylcyanurate; and triallyltrimellitate.

The usage of any one of those cross-linking agents is preferably adjusted according to, for example, the kind of a monomer to be cross-linked and desired physical properties of a binder resin. In general, the usage is 0.01 to 10 parts by mass (preferably 0.03 to 5 parts by mass) with respect to 100 parts by mass of other monomer components constituting the binder resin.

Out of those cross-linkable monomers, aromatic divinyl compounds (especially divinylbenzene) and diacrylate compounds bonded with chains containing aromatic groups and ether bonds are preferably used as resins for developers (binder resins) from the viewpoint of fixability and offset resistance.

In the present invention, other resins such as rosin, modified rosin, an aliphatic or alicyclic hydrocarbon resin can be mixed as required with the binder resin described above. When a mixture of two or more kinds of resins is used as a binder resin, resins having different molecular weights are preferably mixed at an appropriate ratio.

Further, the binder resin to be used in the present invention has a glass transition temperature (Tg) of preferably 45 to 80° C., or more preferably 55 to 70° C., a number average molecular weight (Mn) of preferably 2,500 to 50,000, and a weight average molecular weight (Mw) of 10,000 to 1,000,000.

The number average molecular weight and weight average molecular weight of a binder resin can be determined as follows. First, the binder resin is dissolved into tetrahydrofuran (THF). The solution is used to measure the number of counts (retention time) by means of gel permeation chromatography (GPC). Then, several kinds of monodisperse polystyrene standard samples are used to create a standard curve. The molecular weights can be determined from the number of counts and logarithmic values of the standard curve. The molecular weight of the binder resin can be adjusted by, for example, polymerization conditions, whether a cross-linking agent is used, and the kneading of the binder resin.

In general, the glass transition temperature of a binder resin can be adjusted by selecting a constituent (polymerizable monomer) of the binder resin in such a manner that a theoretical glass transition temperature described in the publication Polymer Handbook, 2nd edition, III, p 139 to 192 (published by John Wiley & Sons) becomes 45 to 80° C. In addition, the glass transition temperature of a binder resin can be measured in accordance with ASTM D3418-82 by means of a differential scanning calorimeter such as a DSC-7 (manufactured by Perkin Elmer Co., Ltd.) or a DSC2920 (manufactured by TA Instruments Japan Inc.). When the glass transition temperature of a binder resin is lower than the above range, storage stability of magnetic toner may be insufficient. On the other hand, when the glass transition temperature of the binder resin is higher than the above range, the fixability of the magnetic toner may be insufficient.

A method of synthesizing a binder resin composed of a vinyl-based polymer or copolymer is not particularly limited, and any one of conventionally known methods can be used. For example, a polymerization method such as block polymerization, solution polymerization, suspension polymerization, or emulsion polymerization can be used. When a carboxylic acid monomer or an acid anhydride monomer is used, block polymerization or solution polymerization is preferably used in terms of the nature of the monomer to be used.

In addition, the binder resin may contain a THF insoluble matter. The content of the THF insoluble matter to be determined by means of the following method is 0.1 mass % to 60 mass % with respect to the resin in terms of fixability.

The THF insoluble matter content in the binder resin can be determined from the amount of residue when the binder resin is subjected to a Soxhlet extractor by means of tetrahydrofuran (THF) as a solvent. More specifically, the weighed binder resin was placed into extraction thimble (such as No. 86R size 28×10 mm, manufactured by ADVANTEC), and was extracted by means of 200 ml of THF as a solvent for 16 hours at such a reflux rate that the extraction cycle of THF would be once per about 4 to 5 minutes. After the completion of the extraction, the extraction thimble was taken out and weighed so that the THF insoluble matter content in the binder resin was determined from the following expression.

$$\text{THF insoluble matter content (mass \%)} = W2/W1 \times 100$$

In the above expression, W1 represents the mass (g) of the binder resin placed into the extraction thimble, and W2 represents the mass (g) of the binder resin in the extraction thimble after the extraction.

A mixture containing at least a binder resin and a magnetic body is used as a material for producing the magnetic toner of the present invention. In addition, for example, other additives such as a wax, a charge control agent, an inorganic fine powder, a hydrophobic inorganic fine powder, and a known colorant are used as required.

Examples of a wax to be used in the present invention include: aliphatic hydrocarbon-based waxes such as low-molecular-weight polyethylene, low-molecular-weight polypropylene, a polyolefin copolymer, a polyolefin wax, a microcrystalline wax, a paraffin wax, and a Fischer-Tropsch wax; oxides of aliphatic hydrocarbon-based waxes such as an oxidized polyethylene wax, and block copolymers thereof; plant-based waxes such as a candelilla wax, a carnauba wax, a haze wax, and a jojoba wax; animal-based waxes such as a bees wax, lanolin, and a spermaceti wax; mineral-based waxes such as ozokerite, ceresin, and petrolatum; waxes mainly composed of aliphatic esters such as a montanic acid ester wax and a castor wax; and partially or wholly deacidified aliphatic esters such as a deacidified carnauba wax.

The examples of the wax further include: saturated linear aliphatic acids such as palmitic acid, stearic acid, montanic acid, and a long-chain alkylcarboxylic acid having a longer alkyl chain; unsaturated aliphatic acids such as brassidic acid, eleostearic acid, and parinaric acid; saturated alcohols such as stearyl alcohol, eicosyl alcohol, behenyl alcohol, carnaubyl alcohol, ceryl alcohol, melissyl alcohol, and an alkylalcohol having a longer alkyl chain; polyhydric alcohols such as sorbitol; aliphatic amides such as linoleic amide, oleic amide, and lauric amide; saturated aliphatic bisamides such as methylene-bisstearic amide, ethylene-biscapric amide, ethylene-bislauric amide, and hexamethylene-bisstearic amide; unsaturated aliphatic amides such as ethylene-bisoleic amide, hexamethylene-bisoleic amide, N,N'-dioleyladipic amide, and N,N'-dioleylsebacic amide; aromatic bisamides such as m-xylene-bisstearic amide and N,N'-distearylisophthalic amide; aliphatic metal salts (generally called metallic soaps) such as calcium stearate, calcium laurate, zinc stearate, and magnesium stearate; waxes obtained by grafting aliphatic hydrocarbon-based waxes with vinyl-based monomers such as styrene and acrylic acid; partially esterified products between aliphatic acids and polyhydric alcohols such as behenic acid monoglyceride; and methyl ester compounds having hydroxyl groups obtained by hydrogenating vegetable oil and fat.

Those waxes whose molecular weight distributions are sharpened by means of press sweating, a solvent method, recrystallization, vacuum distillation, supercritical gas extraction, or melt crystallization, or those waxes from which low-molecular-weight solid aliphatic acids, low-molecular-weight solid alcohols, low-molecular-weight solid compounds, and other impurities are removed are also preferably used.

The amount of any such wax to be used is preferably 1.0 to 20.0 parts by mass per 100 parts by mass of the binder resin in terms of, for example, developability or releasability.

In addition, in the present invention, a charge control agent is preferably added and used. The chargeability of the magnetic toner of the present invention may be positive or negative; provided that negatively chargeable toner is preferable because the binder resin itself has high negative chargeability.

Specific examples of a negative charge control agent include: metal complexes of monoazo dyes described in, for example, JP 41-20153 B, JP 44-6397 B, and JP 45-26478 B; nitrohumic acid and a salt thereof described in JP 50-133838 A; dyes such as C.I. 14645; metal (such as Zn, Al, Co, Cr, Fe, and Zr) compounds of salicylic acid, naphthoic acid, and dicarboxylic acid described in, for example, JP 55-42752 B, JP 58-41508 B, and JP 59-7385 B; copper sulfonated phthalocyanine pigments; styrene oligomers into which a nitro group and a halogen are introduced; and chlorinated paraffin. Of those, azo-based metal complexes each represented by the following general formula (I) and basic organic acid metal complexes each represented by the following general formula (II), each of which has excellent dispersibility and has effects on the stabilization of an image density and on a reduction in fogging, are preferable.

(I)

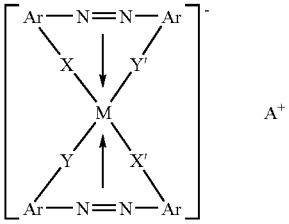

In the general formula (I), M represents a coordination center metal selected from Cr, Co, Ni, Mn, Fe, Ti, and Al. Ar represents an aryl group such as a phenyl group or a naphthyl group, and may have a substituent. Examples of the substituent in this case include a nitro group, a halogen group, a carboxyl group, an anilide group, an alkyl group having 1 to 18 carbon atoms, and an alkoxy group having 1 to 18 carbon atoms. X, X', Y, and Y' each represent —O—, —CO—, —NH—, or —NR— (where R represents an alkyl group having 1 to 4 carbon atoms). $A^+$ represents a hydrogen ion, a sodium ion, a potassium ion, an ammonium ion, or an aliphatic ammonium ion.

(II)

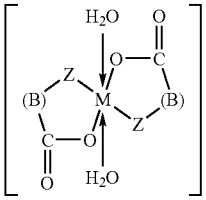

In the general formula (II), M represents a coordination center metal selected from Cr, Co, Ni, Mn, Fe, Ti, Zr, Zn, Si, B, and Al. (B)s each represent any one of the following structural formula (1), the following general formulae (2) to (5), the following structural formula (6) and the following general formulae (7) to (8) each of which may have a substituent such as an alkyl group, and (B)s may be identical to or different from each other. $A'^+$ represents a hydrogen ion, a sodium ion, a potassium ion, an ammonium ion, or an aliphatic ammonium ion. Zs each represent —O— or the following structural formula (9), and Zs may be identical to or different from each other.

(1)

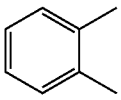

(2)

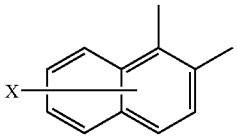

-continued (3)

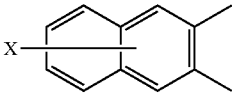

(4)

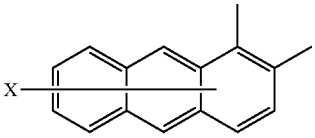

(5)

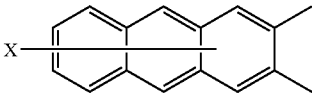

(6)

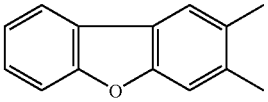

(7)

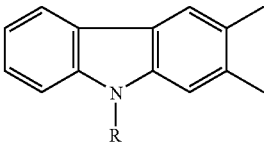

(8)

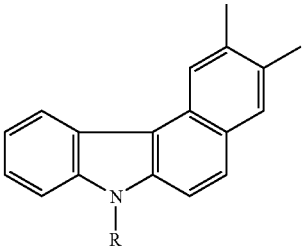

(9)

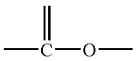

In the formulae (2) to (5), X represents a hydrogen atom, a halogen atom, and a nitro group. In the formulae (7) and (8), R represents a hydrogen atom, an alkyl group having 1 to 18 carbon atoms, or an alkenyl group having 2 to 18 carbon atoms.

Of those, azo-based metal complexes each represented by the general formula (I) are more preferable, and azo-based iron complexes each having Fe as a center metal and each represented by the following formula (III) or (IV) are particularly preferable.

(III)

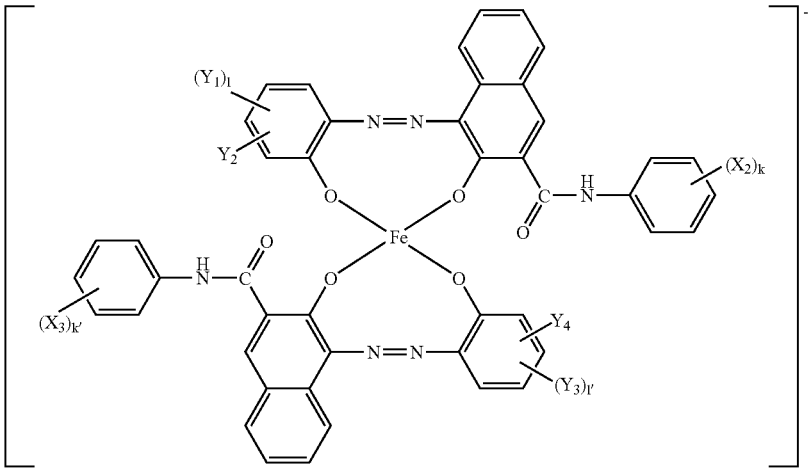

In the general formula (III), $X_2$ and $X_3$ each represent a hydrogen atom, a lower alkyl group, a lower alkoxy group, a nitro group, or a halogen atom. k and k' each represent an integer of 1 to 3. $Y_1$ and $Y_3$ each represent a hydrogen atom, an alkyl group having 1 to 18 carbon atoms, an alkenyl group having 2 to 18 carbon atoms, a sulfonamide group, a mesyl group, a sulfonic group, a carboxyester group, a hydroxy group, an alkoxy group having 1 to 18 carbon atoms, an acetylamino group, a benzoyl group, an amino group, or a halogen atom. l and l' each represent an integer of 1 to 3. $Y_2$ and $Y_4$ each represent a hydrogen atom or a nitro group. $A''^{+}$ represents an ammonium ion, a sodium ion, a potassium ion, a hydrogen ion, or a mixed ion of them, and preferably has 75 to 98 mol % of an ammonium ion. $X_2$ and $X_3$, k and k', $Y_1$ and $Y_3$, l and l', or $Y_2$ and $Y_4$ may be identical to or different from each other.

(IV)

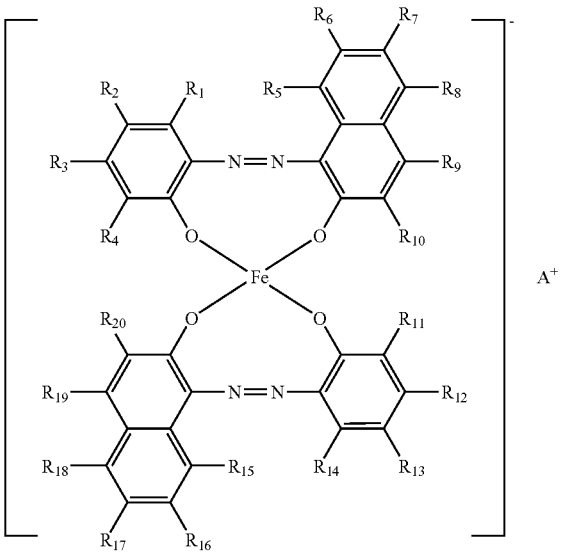

In the general formula (IV), $R_1$ to $R_{20}$ each represent a hydrogen atom, a halogen atom, or an alkyl group, and may be identical to or different from one another. $A^+$ represents an ammonium ion, a sodium ion, a potassium ion, a hydrogen ion, or a mixed ion of them.

Next, specific examples of the azo-based iron complexes each represented by the general formula (III) will be shown.

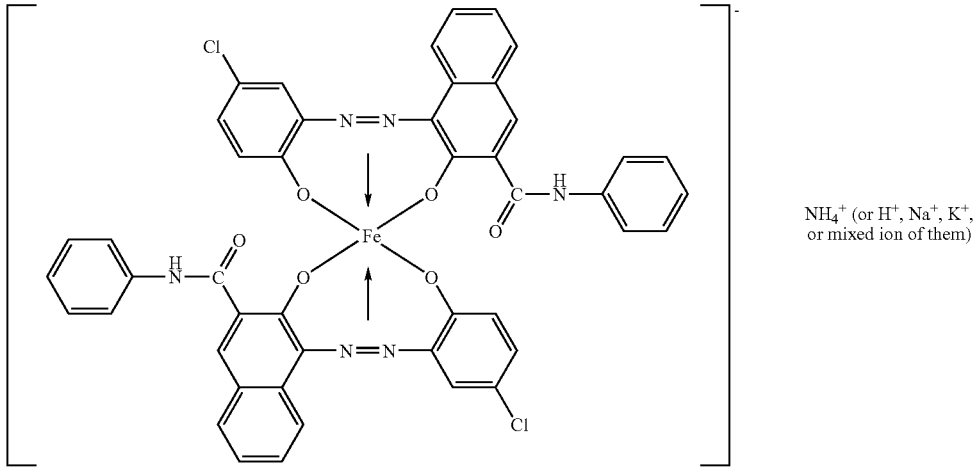

Azo-based iron complex compound (1)

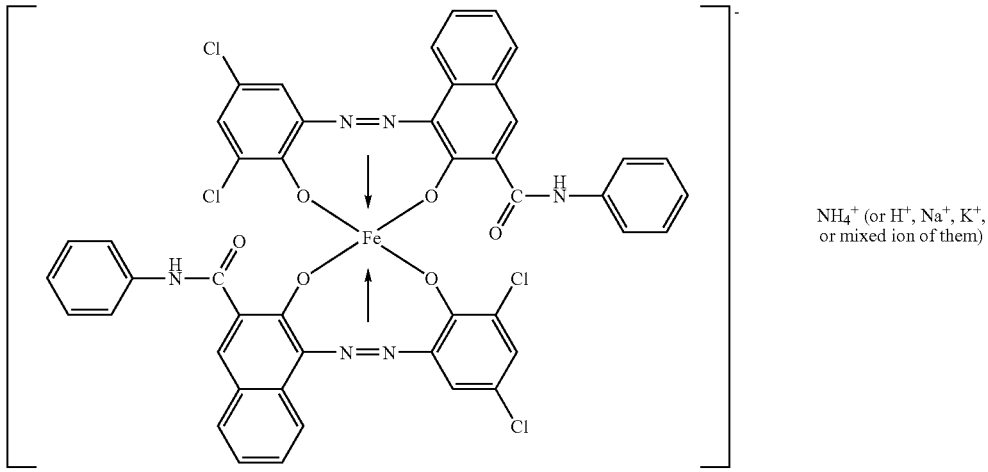

Azo-based iron complex compound (2)

-continued
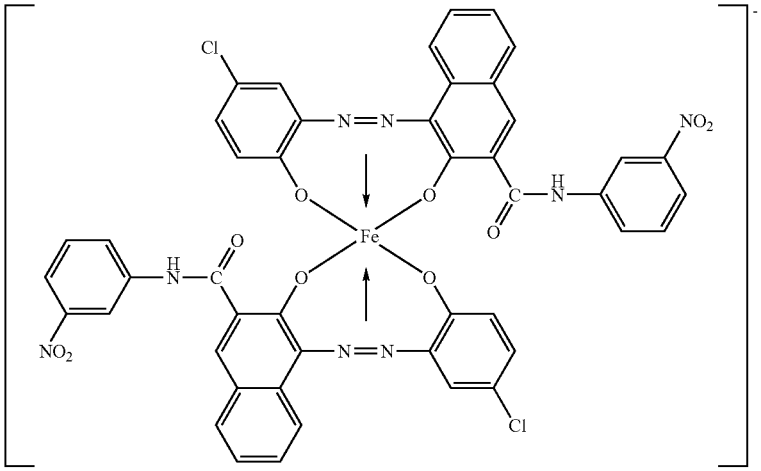
$NH_4^+$ (or $H^+$, $Na^+$, $K^+$, or mixed ion of them)
Azo-based iron complex compound (3)
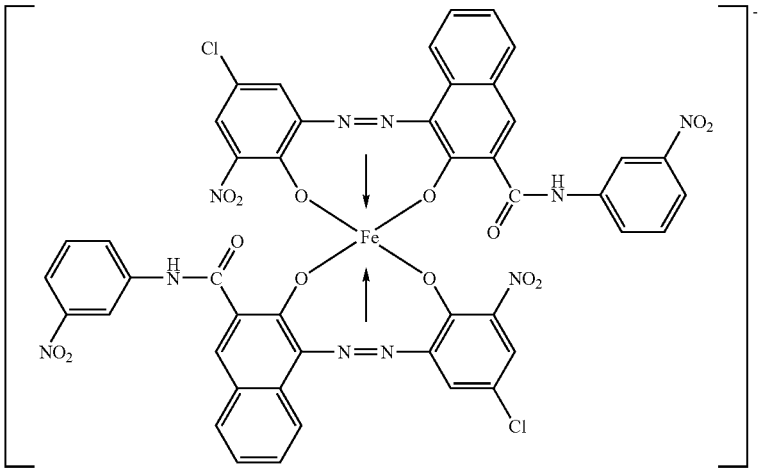
$NH_4^+$ (or $H^+$, $Na^+$, $K^+$, or mixed ion of them)
Azo-based iron complex compound (4)
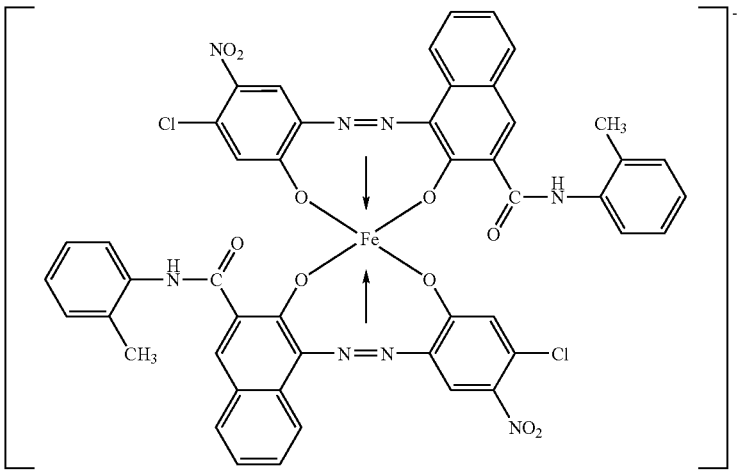
$NH_4^+$ (or $H^+$, $Na^+$, $K^+$, or mixed ion of them)
Azo-based iron complex compound (5)

-continued
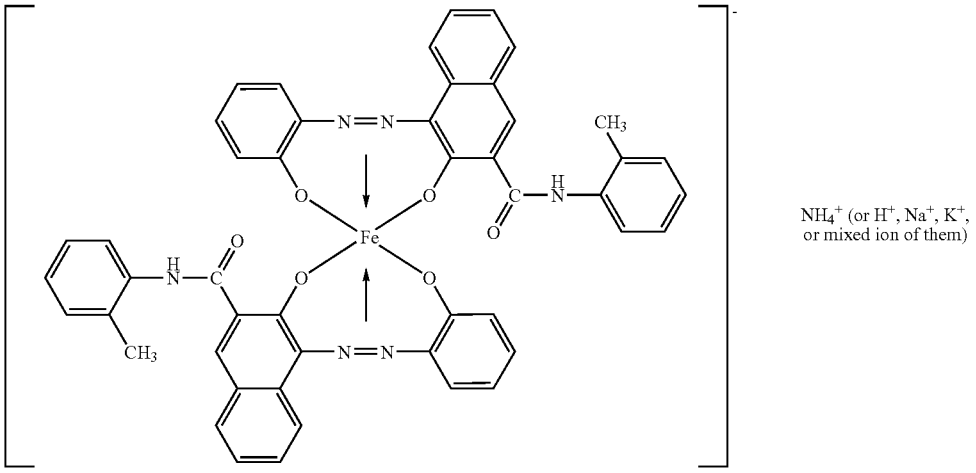
Azo-based iron complex compound (6)
Specific examples of charge control agents represented by the formulae (I), (II), and (IV) are shown below.
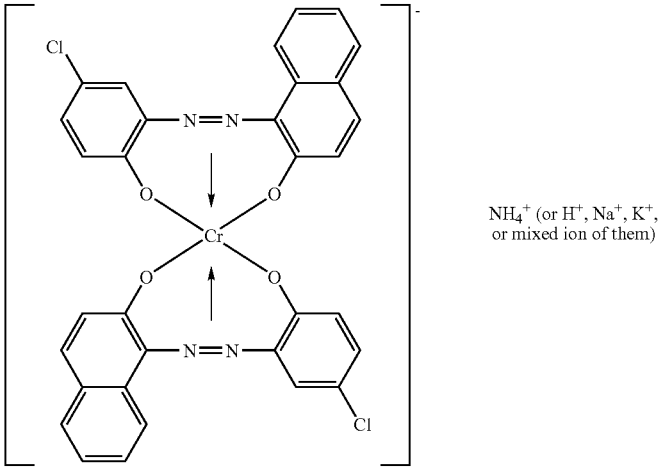
Azo-based iron complex compound (7)
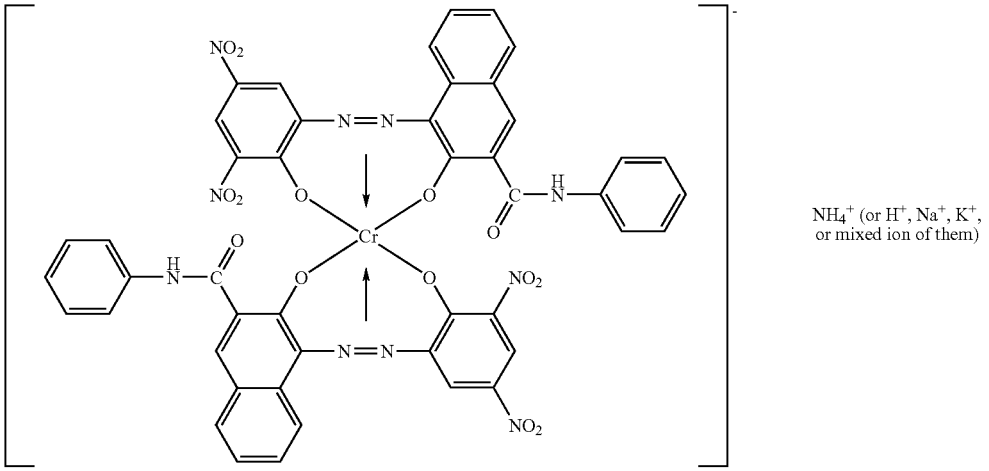
Azo-based iron complex compound (8)

-continued (9)

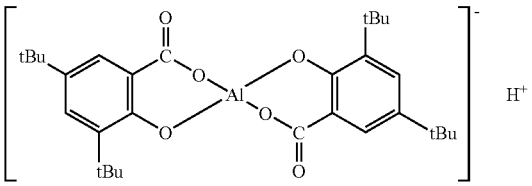

Azo-based iron complex compound (9)

(10)

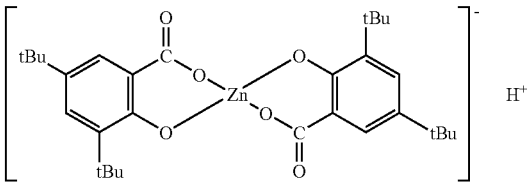

Azo-based iron complex compound (10)

(11)

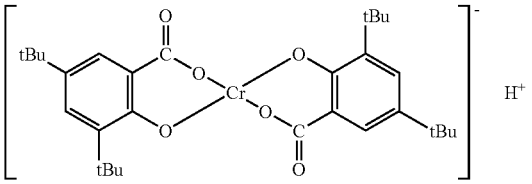

Azo-based iron complex compound (11)

(12)

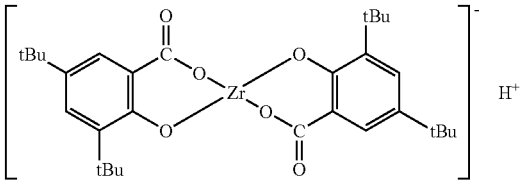

Azo-based iron complex compound (12)

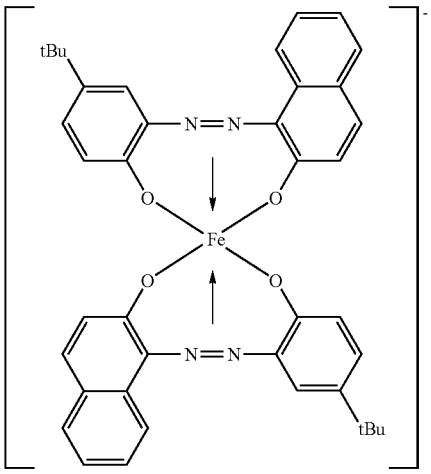

$NH_4^+$ (or $H^+$, $Na^+$, $K^+$, or mixed ion of them)

Azo-based iron complex compound (13)

Each of those metal complex compounds may be used alone, or two or more of them may be used in combination. The usage of any one of those charge control agents is preferably 0.1 to 5.0 parts by mass with respect to 100 parts by mass of a binder resin from the viewpoint of the charge amount of magnetic toner.

Preferable examples of a charge control agent for negative charging include: Spilon Black TRH, T-77, and T-95 (Hodogaya Chemical); and BONTRON (registered trademark) S-34, S-44, S-54, E-84, E-88, and E-89 (Orient Chemical Industries, Ltd.).

Meanwhile, examples of a charge control agent for controlling toner to be positively-chargeable include: nigrosine and modified products thereof with aliphatic metal salts, and so on; quaternary ammonium salts such as tributylbenzyl ammonium-1-hydroxy-4-naphtosulfonate and tetrabutyl ammonium tetrafluoroborate, and analogs thereof, which are onium salts such as phosphonium salt, and lake pigments thereof, and triphenylmethane dyes and lake pigments thereof (lake agents include phosphotungstenic acid, phosphomolybdic acid, phosphotungsten molybdic acid, tannic acid, lauric acid, gallic acid, ferricyanide, and ferrocyanide); metal salts of higher aliphatic acids; diorgano tin oxides such as dibutyl tin oxide, dioctyl tin oxide, and dicyclohexyl tin oxide; and diorgano tin borates such as dibutyl tin borate, dioctyl tin borate, and dicyclohexyl tin borate. Each of them may be used alone, or two or more of them may be used in combination. The usage of any one of those charge control agents is preferably 0.1 to 5.0 parts by mass with respect to 100 parts by mass of a binder resin from the viewpoint of the charge amount of magnetic toner.

Preferable examples of a charge control agent for positive charging include: TP-302 and TP-415 (Hodogaya Chemical); BONTRON (registered trademark) N-01, N-04, N-07, and P-51 (Orient Chemical Industries, Ltd.); and Copy Blue PR (Clariant).

In addition, the magnetic toner of the present invention is preferably mixed with inorganic fine powder or hydrophobic inorganic fine powder. For example, silica fine powder is preferably added to the magnetic toner of the present invention.

The silica fine powder to be used in the present invention may be any one of: so-called dry silica referred to as dry-method or fumed silica produced by vapor phase oxidation of a silicon halide compound; and so-called wet silica produced from, for example, water glass. However, dry silica having a small number of silanol groups on its surface and in it and producing a small amount of production residue is preferable.

Furthermore, the silica fine powder to be used in the present invention is preferably subjected to a hydrophobic treatment. Hydrophobicity is imparted to silica fine powder by chemically treating the silica fine powder with, for example, an organic silicon compound reacting with or physically adsorbing the silica fine powder. An example of a preferable method includes a method involving treating dry silica fine powder produced by the vapor phase oxidation of a silicon halide compound with an organic silicon compound such as silicone oil after or simultaneously with the treatment of the dry silica fine powder with a silane compound.

Examples of the silane compound used for a hydrophobic treatment include, for example, hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilanemercaptan, trimethylsilylmercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, and 1,3-diphenyltetramethyldisiloxane.

An example of the organic silicon compound includes silicone oil. Silicone oil having a viscosity of $3\times10^{-5}$ to $1\times10^{-3}$ $m^2/s$ at 25° C. is used. Examples of preferable silicone oil include a dimethyl silicone oil, a methylhydrogen silicone oil, a methylphenyl silicone oil, an α-methylstyrene-modified silicone oil, a chlorophenyl silicone oil, and a fluorine-modified silicone oil.

Treatment with silicone oil can be performed by, for example, directly mixing silica fine powder treated with a silane compound and silicone oil by means of a mixer such as a Henschel mixer, or injecting silicone oil into silica serving as a base. Alternatively, the treatment can also be performed by: dissolving or dispersing silicone oil into an appropriate solvent; mixing the solution with silica fine powder serving as a base; and removing the solvent.

Any external additive of fine powder other than silica fine powder may be added as required to the magnetic toner of the present invention. Examples of such other external additive include resin fine particles and inorganic fine particles serving as a developability improver, a charging aid, a conductivity imparting agent, a fluidity imparting agent, an anti-caking agent, a lubricant, an abrasive, and the like.

Preferable examples of the other external additive include: lubricants such as polyethylene fluoride, zinc stearate, and polyvinylidene fluoride (in particular, polyvinylidene fluoride); abrasives such as cerium oxide, silicon carbide, and strontium titanate (in particular, strontium titanate); fluidity imparting agents such as titanium oxide and aluminum oxide (in particular, those having hydrophobicity). A small amount of each of anti-caking agents, conductivity imparting agents such as carbon black, zinc oxide, antimony oxide, and tin oxide, and developability improvers such as white and black fine particles having opposite polarity can be used.

The amount of inorganic fine powder or hydrophobic inorganic fine powder to be mixed with the magnetic toner is preferably 0.1 to 5 parts by mass (more preferably 0.1 to 3 parts by mass) with respect to 100 parts by mass of the magnetic toner.

The magnetic toner of the present invention can be produced by means of a known method without any particular limitation except that the magnetic properties are adjusted to satisfy specific ranges. This specification has revealed the specific magnetic property ranges possessed by the magnetic toner of the present invention. Accordingly, one skilled in the art can produce the magnetic toner of the present invention through the adjustment of the step of producing magnetic body particles and magnetic toner in such a manner that magnetic properties satisfy the specific ranges of the present invention on the basis of the description in this specification and technical common sense.

For example, the magnetic toner of the present invention can be obtained by: sufficiently mixing the materials for the magnetic toner described above by means of a mixer such as a Henschel mixer or a ball mill; melting and kneading the mixture by means of a heat kneader such as a roll, a kneader, or an extruder to make resins compatible with each other, dispersing or dissolving magnetic body particles, and a pigment or a dye into the kneaded product; cooling the resultant for solidification; pulverizing the solidified product; classifying the pulverized product; and mixing the classified product with an external additive such as inorganic fine powder as required by means of the above described mixer.

In the above step of producing magnetic toner, the magnetic body is preferably dispersed uniformly because the effect of the present invention can be exerted with improved favorableness. Of course, raw materials should be mixed sufficiently. In addition, in a melting and kneading process by means of a heat kneader, a melting and kneading temperature is preferably set to a high temperature in such a manner that the binder resin can be kneaded in a molten and softened state. In particular, in the case where a binder resin containing a hard component such as a THF insoluble matter is used, when the binder resin is softened at a high temperature before it is kneaded, magnetic body particles can be easily dispersed uniformly.

Examples of the mixer include: a Henschel mixer (manufactured by Mitsui Mining Co., Ltd.); a Super mixer (manufactured by Kawata); a Ribocorn (manufactured by Okawara Corporation); a Nauta mixer, a Turbulizer, and a Cyclomix (manufactured by Hosokawa Micron Corporation); a Spiral pin mixer (manufactured by Pacific Machinery & Engineering Co., Ltd.); and a Lodige mixer (manufactured by Matsubo Corporation).

Examples of the kneader include: a KRC kneader (manufactured by Kurimoto, Ltd.); a Buss co-kneader (manufactured by Buss); a TEM extruder (manufactured by Toshiba Machine Co., Ltd.); a TEX biaxial extruder (manufactured by Japan Steel Works Ltd.); a PCM kneader (manufactured by Ikegai); a Three-roll mill, a Mixing roll mill, and a Kneader (manufactured by Inoue Manufacturing Co., Ltd.); a Kneadex (manufactured by Mitsui Mining Co., Ltd.); an MS pressure kneader and a Kneader-ruder (manufactured by Moriyama Manufacturing Co., Ltd.); and a Banbury mixer (manufactured by Kobe Steels, Ltd.).

Examples of a pulverizer include: a Counter jet mill, a Micronjet, and an Inomizer (manufactured by Hosokawa Micron Corporation); an IDS mill and a PJM jet pulverizer (manufactured by Nippon Pneumatic Mfg, Co., Ltd.); a Cross jet mill (manufactured by Kurimoto, Ltd.); an Urumax (manufactured by Nisso Enginerring Co., Ltd.); an SK Jet O Mill (manufactured by Seishin Enterprise Co., Ltd.); a Kryptron system (manufactured by Kawasaki Heavy Industries); a Turbo mill (manufactured by Turbo Kogyo Co., Ltd.); and a Super rotor (manufactured by Nisshin Engineering Inc.).

Examples of a classifier include: a Classiel, a Micron classifier, and a Spedic classifier (manufactured by Seishin Enterprise Co., Ltd.); a Turbo classifier (manufactured by Nisshin Engineering Inc.); a Micron separator, a Turboplex (ATP), and a TSP separator (manufactured by Hosokawa Micron Corporation); an Elbow jet (manufactured by Nittetsu Mining Co., Ltd.); a Dispersion separator (manufactured by Nippon Pneumatic Mfg, Co., Ltd.); and a YM microcut (manufactured by Yasukawa Shoji).

Examples of a sieving device used for sieving coarse particles and the like include: an Ultrasonic (manufactured by Koei Sangyo Co., Ltd.); a Resonasieve and a Gyrosifter (manufactured by Tokuju Corporation); a Vibrasonic system (manufactured by Dalton Corporation); a Soniclean (manufactured by Shintokogio Ltd.); a Turbo screener (manufactured by Turbo Kogyo Co., Ltd.); a Microsifter (manufactured by Makino mfg Co., Ltd.); and a circular vibrating screen.

The magnetic toner of the present invention preferably has a weight average particle size of 4.5 to 10 μm, more preferably 5.0 to 9.2 μm, or still more preferably 5.2 to 7.7 μm. A magnetic toner having a weight average particle size in excess of 10 μm is not preferable because it is difficult to achieve high image quality involving the problems of fogging and fine-line reproducibility owing to the sizes of the toner particles themselves. A magnetic toner having a weight average particle size of less than 4.5 μm is not preferable because such toner may accelerate fogging and scattering even when the magnetic body particles of the present invention are used.

The weight average particle size can be measured, for example, by means of a Coulter Multisizer II (manufactured by Beckman Coulter, Inc, trade name) as a particle size measuring device. For example, the weight average particle size can be measured by connecting a Coulter Multisizer II to an interface (manufactured by Nikkaki Bios Co., Ltd.) and a personal computer for outputting a number distribution and a volume distribution.

A 1% aqueous solution of NaCl prepared by dissolving first-grade sodium chloride into water can be used as an electrolyte to be used for preparing a sample to be tested. For example, an ISOTON R-II (manufactured by Coulter Scientific Japan, Co., trade name) may also be used as the electrolyte.

The sample to be tested can be prepared by: adding 0.1 to 5 ml of a surfactant, preferably alkylbenzene sulfonate, as a dispersant to 100 to 150 ml of the electrolyte; adding 2 to 20 mg of a developer sample (magnetic toner) to the mixture; and subjecting the resultant to a dispersion treatment by means of an ultrasonic dispersing unit for about 1 to 3 minutes. A 100-μm aperture can be used as an aperture in the measurement of the weight average particle size by means of the Coulter Multisizer.

The volume and number of a group of magnetic toner particles each having a particle size of 2 μm or more are measured to calculate a volume distribution and a number distribution. The weight average particle size in the present invention can be determined from the volume distribution on a weight basis (the central value of each channel is defined as a representative value).

The weight average particle size of magnetic toner can be adjusted by, for example, the pulverization and classification of the magnetic toner, and mixing of a classified product having an appropriate particle size.

The magnetic toner of the present invention is suitably used as a one-component developer. For example, the magnetic toner of the present invention can be used for image formation by means of a conventionally known image forming apparatus for a one-component developer such as one having a developing device for one-component jumping development or a developing and cleaning device that carries out supply of magnetic toner to a photosensitive member (development) and recovery of transfer residual toner from the photosensitive member. The magnetic toner of the present invention can also be suitably used for a process cartridge integrally attached to the main body of an image forming apparatus, the process cartridge having at least a developing device storing the magnetic toner of the present invention and a photosensitive member on which an electrostatic latent image to be developed as a toner image with the magnetic toner of the present invention is formed.

A conductive cylinder formed of a metal or an alloy such as aluminum or stainless steel is preferably used for a magnetic toner bearing member preferably used for carrying the magnetic toner of the present invention. A conductive cylinder may be formed of a resin composition having a sufficient mechanical strength and sufficient conductivity. Alternatively, a conductive rubber roller may be used. In addition, the shape of the carrier is not limited to a cylindrical shape, and may be, for example, a rotating endless belt shape.

In particular, the surface of the magnetic toner bearing member is preferably coated with a resin layer into which at least one of a conductive fine particle and a lubricant is dispersed because the charging of the magnetic toner can be easily controlled.

Examples of a resin that can be used for the resin layer include: thermoplastic resins such as a styrene-based resin, a vinyl-based resin, a polyether sulfone resin, a polycarbonate resin, a polyphenylene oxide resin, a polyamide resin, a fluorine resin, a fibrous resin, and an acrylic resin; and thermosetting resins or photocurable resins such as an epoxy resin, a polyester resin, an alkyd resin, a phenol resin, a melamine resin, a polyurethane resin, a urea resin, a silicone resin, and a polyimide resin.

Of those, a resin having releasability such as a silicone resin or a fluorine resin, or a resin excellent in mechanical properties such as a polyether sulfone resin, a polycarbonate resin, a polyphenylene oxide resin, a polyamide resin, a phenol resin, a polyester resin, a polyurethane resin, or a styrene-based resin is more preferable.

Conductive fine particles to be incorporated into the resin layer are preferably formed by using one or two or more of carbon black, graphite, a conductive metal oxide and a conductive metal double oxide such as conductive zinc oxide, and the like.

The surface roughness of the magnetic toner bearing member to be used in the present invention represented in a JIS center line average roughness (Ra) is preferably in the range of 0.2 to 3.5 μm. When Ra is less than 0.2 μm, a charge amount on the magnetic toner bearing member increases, so developability tends to be insufficient. When Ra exceeds 3.5 μm, unevenness occurs in a toner coat layer on the magnetic toner bearing member, and it tends to be density unevenness on an image. Ra is more preferably in the range of 0.2 to 3.0 μm. In the present invention, Ra corresponds to a center line average roughness measured by means of a surface roughness measuring device (Surf-Corder SE-30H, manufactured by Kosaka Laboratory Ltd.) on the basis of JIS surface roughness "JIS B 0601".

Ra can be adjusted to fall within the above range by, for example, changing the abraded state of the surface layer of the toner carrier or adding a spherical carbon particle, a carbon fine particle, graphite, or the like.

In addition, the magnetic toner bearing member (developing sleeve) has a fixed magnet having multiple poles in it. The number of magnetic poles is preferably 3 to 10.

The diameter of the developing sleeve to be used is appropriately selected from about Φ10 mm to about Φ30 mm depending on a machine speed, and the strength of a magnetic pole is appropriately determined on the basis of a tradeoff relationship among the machine speed, the developing sleeve diameter, and the developability of the magnetic toner. The strength of each of a magnetic pole at a developing portion and a magnetic pole at a toner amount regulating portion is preferably 1,000 gauss (0.1 tesla) or less for suppressing the formation of a long nap of the magnetic toner at the developing portion.

EXAMPLES

Hereinafter, the present invention will be described by way of production examples and examples. However, the present invention is not limited to these examples. It is easy for one skilled in the art to obtain magnetic bodies having physical properties of Production Examples 2 to 10 of Magnetic body through appropriate changes in conditions of Production Example 1 with reference to documents such as "Magnetite as Functional Material for Electrophotography" by Hideaki Tokunaga, Akira Nakamura, and Hiroshi Majima, Materia Vol. 34, No. 1 (1995), p. 3, "Magnetite Particle for Electrophotography Application" by Masahiro Miwa, Takashi Nakajima, et al., Journal of the Imaging Society of Japan, Vol. 43, No. 5 (2004), p. 35, Japanese Patent No. 3134978, and Japanese Patent No. 3259744.

Production Example 1 of Magnetic Body

An aqueous solution of ferrous sulfate (1.5 mol/l) was mixed with 0.965 equivalent of an aqueous solution of sodium hydroxide (2.8 mol/l) with respect to $Fe^{2+}$ to prepare an aqueous solution of ferrous salt containing $Fe(OH)_2$.

After that, soda silicate was added in an amount of 0.4 mass % in terms of an Si element with respect to an Fe element. Next, the aqueous solution of ferrous salt containing $Fe(OH)_2$ was aerated at a temperature of 90° C. and a flow rate of 80 l/min, and subjected to an oxidation reaction at a pH of 6 to 7 for 2 hours to produce a maternal magnetic body core containing an Si element.

Furthermore, 1.05 equivalents of an aqueous solution of sodium hydroxide (2.8 mol/l), into which 0.2 mass % (in terms of an Si element with respect to all Fe element) of soda silicate had been dissolved, with respect to remaining $Fe^{2+}$ were added to the suspension containing the material magnetic body core. The mixture was subjected to an oxidation reaction at a pH of 8 to 10.5 for 1 hour while being heated at a temperature of 90° C. Thus, a maternal magnetic body containing an Si element was produced. The produced magnetic body was washed, filtered, and dried according to an ordinary method. After that, the resultant was classified by means of a dry classifier for cutting fine and coarse powders. Thus, a maternal magnetic body A was produced.

Next, the maternal magnetic body A was dispersed into water to prepare an aqueous suspension having a concentration of 100 g/l, and the temperature of the aqueous suspension was held at 80° C. or higher. An aqueous solution of sodium hydroxide was added to adjust the pH of the aqueous suspension to 9.8. An aqueous solution of sodium silicate was added in an amount equivalent to 2.1 mass % in terms of $SiO_2/Fe_3O_4$ to the aqueous suspension while the aqueous suspension was stirred. Next, dilute sulfuric acid was added to reduce the pH of the aqueous suspension gradually. The pH of the aqueous suspension was finally reduced to 6.5 over about 4 hours.

The resultant was washed, filtered, dried, and shredded according to an ordinary method. Thus, the magnetic body A having formed thereon a high-density $SiO_2$ coating layer was produced.

The magnetic body A coated with $SiO_2$ was subjected to a compression treatment by means of a Sand Mill MPUV-2 (manufactured by Yodo Casting, Ltd.). Subsequently, the resultant was subjected to a shredding treatment. Thus, a magnetic body 1 was produced. Table 1 shows the physical properties of the magnetic body 1.

Production Example 2 of Magnetic Body

A maternal magnetic body B was produced in the same manner as in Production Example 1 of Magnetic body except that the temperature at which the oxidation reaction was performed and the time period for which the oxidation reaction was performed were changed.

Next, the maternal magnetic body B were dispersed into water to prepare an aqueous suspension having a concentration of 100 g/l, and the aqueous suspension was held at 60 to 80° C. An aqueous solution of sodium hydroxide or dilute sulfuric acid was added to adjust the pH of the aqueous suspension to 5 to 6. An aqueous solution of titanium sulfate having a $TiO_2$ concentration of 80 g/l was added in an amount equivalent to 4.2 mass % in terms of $TiO_2/Fe_3O_4$ to the aqueous suspension over about 1 hour while the aqueous suspension was stirred. At this time, an aqueous solution of sodium hydroxide was simultaneously added to maintain the pH of the aqueous suspension at 5 to 6. Next, an aqueous solution of sodium hydroxide was added to adjust the pH of the aqueous suspension to neutral.

The resultant was washed, filtered, dried, and shredded according to an ordinary method to produce magnetic body B having a high-density $TiO_2$-coated layer formed.

The magnetic body B coated with $TiO_2$ was subjected to a compression treatment by means of a Sand Mill MPUV-2 (manufactured by Yodo Casting, Ltd.). Subsequently, the resultant was subjected to a shredding treatment. Thus, a magnetic body 2 was produced. Table 1 shows the physical properties of the magnetic body 2.

Production Examples 3 to 5 of Magnetic Body

In each of Production Examples 3 and 4, each of magnetic bodies 3 and 4 was produced in the same manner as in Production Example 1 of Magnetic body except that: the temperature at which the oxidation reaction was performed and the time period for which the oxidation reaction was performed were changed; and the amount of the aqueous solution of sodium silicate was changed. In Production Example 5 (magnetic body 5), a magnetic body 5 was produced in the same manner as in Production Example 1 of Magnetic body except that: the temperature at which the oxidation reaction was performed and the time period for which the oxidation reaction was performed were changed; the amount of the aqueous solution of sodium silicate was changed; and the classifying step after the filtration and drying of the produced maternal magnetic body was omitted. Table 1 shows the physical properties of the magnetic bodies 3 to 5.

Production Example 6 of Magnetic Body

A maternal magnetic body F having an octahedral shape was produced in the same manner as in Production Example 1 of Magnetic body except that: the temperature at which the oxidation reaction was performed, the time period for which the oxidation reaction was performed, and the pH at which the oxidation reaction was performed were changed; and the classifying step after the filtration and drying of the produced magnetic body was omitted.

Next, the maternal magnetic body F was dispersed into water to prepare an aqueous suspension having a concentration of 100 g/l, and the temperature of the aqueous suspension was held at 60 to 80° C. An aqueous solution of sodium hydroxide or dilute sulfuric acid was added to adjust the pH of the aqueous suspension to 10 to 11. An aqueous solution of aluminum sulfate having a $Al_2O_3$ concentration of 100 g/l was added in an amount equivalent to 5.6 mass % in terms of $Al_2O_3/Fe_3O_4$ to the aqueous suspension over about 1 hour while the aqueous suspension was stirred. At this time, an aqueous solution of sodium hydroxide was simultaneously added to maintain the pH of the aqueous suspension at 10 to 11. Next, an aqueous solution of sodium hydroxide was added to adjust the pH of the aqueous suspension to neutral.

The resultant was washed, filtered, dried, and shredded according to an ordinary method. Thus, the magnetic body F having formed thereon a high-density $Al_2O_3$ coating layer was produced.

The magnetic body F coated with $Al_2O_3$ was subjected to a compression treatment by means of a Sand Mill MPUV-2 (manufactured by Yodo Casting, Ltd.). Subsequently, the resultant was subjected to a shredding treatment. Thus, a magnetic body 6 was produced. Table 1 shows the physical properties of the magnetic body 6.

Production Example 7 of Magnetic Body

A magnetic body having an octahedral shape and coated with $Al_2O_3$ was produced in the same manner as in Production Example 6 of Magnetic body except that: the temperature at which the oxidation reaction was performed and the time period for which the oxidation reaction was performed were changed; and the amount of the aqueous solution of aluminum sulfate was changed. After that, the magnetic body was subjected to a heat treatment at 175° C. for 30 minutes in the air. Thus, a magnetic body 7 was produced. Table 1 shows the physical properties of the magnetic body 7.

Production Example 8 of Magnetic Body

A magnetic body was produced in the same manner as in Production Example 1 of Magnetic body except that the temperature at which the oxidation reaction was performed and the time period for which the oxidation reaction was performed were changed. The resultant magnetic body was washed, filtered, and dried according to an ordinary method. Thus, a maternal magnetic body H was produced. It was confirmed that the maternal magnetic body H had a number average particle size of 0.19 μm. After that, the magnetic body was classified by means of a dry classifier while adjustment was performed in such a manner that especially a coarse powder would be cut. Thus, a maternal magnetic body I having a number average particle size of 0.17 μm was produced. The maternal magnetic body I was subjected to a treatment for coating with $SiO_2$, a compression treatment, and a shredding treatment in the same manner as in Production Example 1 of Magnetic body except that the amount of the aqueous solution of sodium silicate was changed. Thus, a magnetic body 8 was produced. A yield reduced owing to a large loss in the classifying step. Table 1 shows the physical properties of the magnetic body 8.

Production Example 9 of Magnetic Body

A maternal magnetic body J was produced in the same manner as in Production Example 1 of Magnetic body except that: the temperature at which the oxidation reaction was performed and the time period for which the oxidation reaction was performed were changed; manganese sulfate was added in an amount of 4.0 mass % in terms of an Mn element with respect to an Fe element during the reaction; and the classifying step after the filtration and drying of the produced magnetic body was omitted. The maternal magnetic body J was subjected to a compression treatment in the same manner as that described above except that no treatment for coating with an oxide was performed. Thus, a magnetic body 9 was produced. Table 1 shows the physical properties of the magnetic body 9.

Production Example 10 of Magnetic Body

A maternal magnetic body K-1 having a number average particle size of 0.12 μm and an octahedral shape was produced in the same manner as in Production Example 1 of Magnetic body except that: the temperature at which the oxidation reaction was performed and the time period for which the oxidation reaction was performed were changed; and the classifying step after the filtration and drying of the produced magnetic body was omitted. Separately, a maternal magnetic body K-2 having a number average particle size of 0.25 μm and a spherical shape was produced in the same manner as in Production Example 1 of Magnetic body except that: the temperature at which the oxidation reaction was performed and the time period for which the oxidation reaction was performed were changed; and the classifying step after the filtration and drying of the produced magnetic body was omitted. The magnetic body K-1 and the magnetic body K-2 were mixed at a mass ratio of 50:50. Thus, a maternal magnetic body K was produced. The measured number average particle size of the maternal magnetic body K was 0.19 μm. The maternal magnetic body K was subjected to a treatment for coating with $Al_2O_3$, a compression treatment, and a shredding treatment in the same manner as in Production Example 6 of Magnetic body except that the amount of the aqueous solution of aluminum sulfate was changed. Thus, a magnetic body 10 was produced. Table 1 shows the physical properties of the magnetic body 10.

TABLE 1

Physical properties of magnetic bodies

| | Ms ($Am^2/kg$) | Mr ($Am^2/kg$) | Number average particle size (μm) | Particle size standard deviation (μm) | Oxide | Oxide coating amount (mass %) | Isoelectric point (—) |
|---|---|---|---|---|---|---|---|
| Magnetic body 1 | 86.5 | 6.8 | 0.16 | 0.034 | $SiO_2$ | 2.0 | 2.1 |
| Magnetic body 2 | 87.0 | 6.2 | 0.18 | 0.044 | $TiO_2$ | 4.0 | 5.4 |
| Magnetic body 3 | 85.0 | 12.8 | 0.10 | 0.039 | $SiO_2$ | 3.5 | 1.9 |

TABLE 1-continued

Physical properties of magnetic bodies

| | Ms ($Am^2/kg$) | Mr ($Am^2/kg$) | Number average particle size (μm) | Particle size standard deviation (μm) | Oxide | Oxide coating amount (mass %) | Isoelectric point (—) |
|---|---|---|---|---|---|---|---|
| Magnetic body 4 | 86.0 | 5.8 | 0.19 | 0.048 | $SiO_2$ | 5.2 | 1.8 |
| Magnetic body 5 | 84.9 | 14.5 | 0.08 | 0.037 | $SiO_2$ | 0.6 | 4.3 |
| Magnetic body 6 | 82.3 | 15.2 | 0.09 | 0.040 | $Al_2O_3$ | 5.5 | 8.9 |
| Magnetic body 7 | 75.8 | 13.8 | 0.20 | 0.055 | $Al_2O_3$ | 0.7 | 6.3 |
| Magnetic body 8 | 67.4 | 5.6 | 0.17 | 0.028 | $SiO_2$ | 12.0 | 4.1 |
| Magnetic body 9 | 93.2 | 5.2 | 0.32 | 0.067 | — | — | 6.5 |
| Magnetic body 10 | 82.5 | 11.0 | 0.19 | 0.059 | $Al_2O_3$ | 4.0 | 6.8 |

Production Example 1 of Binder Resin 40 parts by mass of bisphenol A added with 2 moles of polypropylene oxide, 70 parts by mass of bisphenol A added with 2 moles of polyethylene oxide 87 parts by mass of terephthalic acid, 3 parts by mass of trimellitic anhydride, and 0.5 part by mass of dibutyltin oxide were fed into a reaction vessel, and the whole was subjected to polycondensation at 220° C. to produce a binder resin 1 made of polyester. The resin had an acid value of 3.6 mgKOH/g, a hydroxyl value of 22 mgKOH/g, a Tg of 65° C., and a THF insoluble matter content of 4 mass %.

Production Example 2 of Binder Resin 300 parts by mass of xylene were placed into a four-necked flask, and were refluxed while the temperature was increased. Then, a mixed solution of 80 parts by mass of styrene, 20 parts by mass of n-butyl acrylate, and 2 parts by mass of di-tert-butyl peroxide was dropped over 5 hours to produce a solution of a low-molecular-weight polymer (L-1).

Meanwhile, 180 parts by mass of deaerated water and 20 parts by mass of a 2-mass % aqueous solution of polyvinyl alcohol were charged into another four-necked flask. Then, a mixed solution of 75 parts by mass of styrene, 25 parts by mass of n-butyl acrylate, 0.005 part by mass of divinylbenzene, and 0.1 part by mass of 2,2-bis(4,4-di-tert-butylperoxycyclohexyl)propane (having a half life 10-hour temperature of 92° C.) was added to the flask, and the whole was stirred to prepare a suspension. After the air in the flask had been sufficiently replaced with nitrogen, the temperature of the flask was increased up to 85° C. for polymerization of the mixture in the flask. This state was maintained for 24 hours. After that, 0.1 part by mass of benzoyl peroxide (having a half life 10-hour temperature of 72° C.) was added to the flask, and the whole was maintained for an additional 12 hours to complete the polymerization of a high-molecular-weight polymer (H-1).

25 parts by mass of the high-molecular-weight polymer (H-1) were placed into 300 parts by mass of a uniform solution of the low-molecular-weight polymer (L-1), and the whole was sufficiently mixed under reflux. After that, an organic solvent was distilled off to produce a styrene-based binder resin 2. The binder resin had an acid value of 0 mgKOH/g, a hydroxyl value of 0 mgKOH/g, a Tg of 57° C., and a THF insoluble matter content of 0 mass %.

| (Production Example 1 of Magnetic Toner) | |
|---|---|
| Binder resin 1: | 100 parts by mass |
| Wax: (low-molecular-weight polyethylene, DSC highest peak temperature: 102° C., Mn: 850) | 3 parts by mass |
| Magnetic body 1: | 95 parts by mass |
| T-77 (Hodogaya Chemical): | 2 parts by mass |

The above raw materials were premixed by means of a Henschel mixer (manufactured by Mitsui Mining Co., Ltd.) as a mixer. The resultant premixture was kneaded by means of a biaxial kneading extruder set at 200 rpm while a set temperature was adjusted in such a manner that a direct temperature near the outlet of a kneaded product would be 150 to 160° C. The resultant kneaded product was cooled and coarsely pulverized by means of a cutter mill. After that, the resultant coarsely pulverized product was finely pulverized by means of a Turbo mill (manufactured by Turbo Kogyo Co., Ltd.). The finely pulverized product was classified by means of a multi-division classifier utilizing a Coanda effect to produce negatively chargeable magnetic toner particles 1 having a weight average particle size (D4) of 6.2 μm.

1.0 part by mass of hydrophobic silica fine particles was externally added to and mixed with 100 parts by mass of the magnetic toner particles 1 by means of a Henschel mixer (manufactured by Mitsui Mining Co., Ltd.) to produce a magnetic toner 1. Table 2 shows the physical properties of the magnetic toner 1.

Production Examples 2 to 6 of Magnetic Toners

Each of magnetic toners 2 to 6 was produced in the same manner as in Production Example 1 of Magnetic Toner except that: the binder resin and the magnetic body particles were changed as shown in Table 2; and the weight average particle size of toner particles was adjusted in pulverization and classification processes. Table 2 shows the physical properties of the magnetic toners 2 to 6.

Production Examples 7 to 10 of Comparative Magnetic Toners

Each of comparative magnetic toners 7 to 10 was produced in the same manner as in Production Example 1 of Magnetic Toner except that: the binder resin and the magnetic body particles were changed as shown in Table 2; and the weight average particle size of toner particles was adjusted in pulverization and classification processes. Table 2 shows the physical properties of the comparative magnetic toners 7 to 10.

TABLE 2

| | | | | Toner physical properties | | | | | | | | |
|---|---|---|---|---|---|---|---|---|---|---|---|---|
| Name of toner | Binder resin | Magnetic body | Number of parts of magnetic body (parts by mass) | D4 (μm) | H95% (kA/m) | Hc (kA/m) | Hc/d | H90% (kA/m) | σs ($Am^2/kg$) | σr ($Am^2/kg$) | σs/σr (—) | d2/d1 (—) |
| Magnetic toner 1 | Binder resin 1 | Magnetic body 1 | 95 | 6.2 | 158 | 8.5 | 53.1 | 120 | 40.5 | 3.2 | 12.6 | 0.998 |
| Magnetic toner2 | Binder resin 2 | Magnetic body 2 | 95 | 5.7 | 191 | 8.0 | 44.4 | 144 | 41.0 | 2.9 | 14.1 | 0.994 |
| Magnetic toner 3 | Binder resin 1 | Magnetic body 3 | 70 | 9.5 | 152 | 10.9 | 109.0 | 108 | 32.5 | 4.9 | 6.63 | 0.982 |
| Magnetic toner 4 | Binder resin 2 | Magnetic body 4 | 120 | 5.2 | 180 | 7.8 | 41.1 | 130 | 45.1 | 3.2 | 14.1 | 0.980 |
| Magnetic toner 5 | Binder resin 2 | Magnetic body 5 | 50 | 8.0 | 160 | 11.5 | 143.8 | 123 | 27.0 | 4.3 | 6.28 | 0.990 |
| Magnetic toner 6 | Binder resin 1 | Magnetic body 6 | 150 | 7.4 | 196 | 11.2 | 124.4 | 147 | 47.6 | 8.1 | 5.87 | 0.978 |
| Comparative magnetic toner 7 | Binder resin 1 | Magnetic body 7 | 95 | 5.1 | 210 | 11.9 | 54.1 | 150 | 34.5 | 6.4 | 5.39 | 0.985 |
| Comparative magnetic toner 8 | Binder resin 1 | Magnetic body 8 | 50 | 7.5 | 148 | 6.7 | 39.4 | 105 | 20.4 | 1.6 | 12.8 | 0.996 |
| Comparative magnetic toner 9 | Binder resin 2 | Magnetic body 9 | 130 | 5.1 | 140 | 7.5 | 23.4 | 100 | 52.1 | 2.9 | 18.0 | 0.981 |
| Comparative magnetic toner 10 | Binder resin 2 | Magnetic body 10 | 110 | 10.2 | 230 | 12.5 | 65.8 | 162 | 40.5 | 5.2 | 7.79 | 0.979 |

Example 1

Evaluation 1

A commercially available LBP printer (Laser Jet 4300, manufactured by Hewlett-Packard Development Company, L.P.) was reconstructed so as to be capable of printing 60 sheets of A4 size paper/min (a process speed of 380 mm/sec). In addition, a reconstructed process cartridge was mounted on the reconstructed printer. In the reconstructed process cartridge, the volume of a toner filling portion was increased by a factor of 2. The toner filling portion was filled with the magnetic toner 1 produced in Production Example 1 of Magnetic Toner. A sleeve having a magnet with a strength of a magnetic pole of a developing pole of 750 gauss in it, the sleeve having a surface roughness Ra of 0.8 μm and a diameter of Φ20 mm, was incorporated as a developing sleeve into the cartridge.

The above printer to be used as an image output test machine was left standing in a low-temperature-and-low-humidity environment of 15° C. and 10% RH overnight. After that, a 30,000-sheet print durability test was performed by means of A4-sized plain paper (75 $g/m^2$) in the mode described below. In the mode, a transverse line pattern having a printing ratio of 3% was printed on 1 sheet per one job, and the machine was suspended between one job and the next job before the next job started.

Image properties and a photosensitive member flaw shown below were evaluated during the print durability test or after the 30,000-sheet durability test.

An image density was measured by measuring the reflection density of a 5-mm square solid black image by means of a Macbeth densitometer (manufactured by Gretag Macbeth) as a reflection densitometer with an SPI filter. As a result, a reflection density before the duration was 1.53, and a reflection density after the duration was 1.52. This means that density stability was good. The solid black image was printed and visually observed. As a result, the image was an image having no unevenness and a uniform density. Table 3 shows the results.

The evaluation criteria for an image density are shown below.

A reduction rate of the reflection density after the duration of 30,000 sheets to the reflection density after the duration of 1,000 sheets was calculated. In addition, a solid black image was outputted after the duration of 30,000 sheets, and was visually evaluated. The results of the calculation and of the evaluation were classified as described below.

A: The reduction rate was less than 2%, and a solid black image with no density unevenness was obtained even after the duration of 30,000 sheets.

B: The reduction rate was 2% or more and less than 3%, and a solid black image with no density unevenness was obtained even after the duration of 30,000 sheets.

C: The reduction rate was 3% or more and less than 5%, and slight density unevenness was observed after the duration of 30,000 sheets.

D: The reduction rate was 5% or more, or density unevenness was remarkable after the duration of 30,000 sheets.

The amplitude of an alternating component of a developing bias was set to 1.8 kV (a condition for accelerating fogging, the default is 1.6 kV) on completion of the duration of 10,000 sheets during the durability test. After that, 2 sheets of solid white were printed, and fogging on the second sheet was measured according to the following method.

The reflection densities of a transfer material before and after image formation were measured by means of a reflection densitometer (REFLECTOMETER MODEL TC-6DS manufactured by Tokyo Denshoku). The worst value of the reflection density after the image formation was denoted by Ds, and the average reflection density of the transfer material before the image formation was denoted by Dr to determine the value of (Ds−Dr). The determined value was evaluated as a fogging amount. The lower the value, the smaller the fogging amount. As a result, the fogging amount was 0.9. This is a good result. Table 3 shows the results.

The evaluation criteria of fogging are shown below.

A: Less than 1.0.

B: 1.0 or more and less than 2.0.

C: 2.0 or more and less than 3.5.

D: 3.5 or more.

Scattering of toner to the peripheral portion of a letter upon printing on cardboard (105 g/m$^2$) was visually evaluated subsequently to the evaluation for fogging on completion of the duration of 10,000 sheets during the durability test. As a result, nearly no scattering was observed, and a sharp letter image was obtained. Table 3 shows the results.

The evaluation criteria for scattering are shown below.

A: Nearly no scattering is observed.

B: Scattering is slightly observed, but is not annoying.

C: Scattering is slightly remarkable and may be annoying, but is practically acceptable.

D: Scattering is remarkable, and a letter that is collapsed to be unreadable is present.

An evaluation for fine-line reproducibility was performed subsequently to the evaluations for fogging and scattering on completion of the duration of 10,000 sheets during the durability test.

At first, a fixed image printed on cardboard (105 g/m$^2$) through laser exposure in such a manner that the line width of a latent image would be 85 μm was used as a measurement sample. A line width was measured by means of an indicator from an enlarged monitor screen using a LUZEX 450 particle analyzer as a measuring device. At this time, the position at which a line width was measured had irregularities in the width direction of a fine-line image of toner. Therefore, the average line width of the irregularities was defined as a point of measurement. The evaluation for fine-line reproducibility was performed by calculating a ratio (line width ratio) of the measured line width to the line width (85 μm) of the latent image. Therefore, the remarkable tailing of the fixed image results in a reduction in fine-line reproducibility. As a result, a value for the line width ratio was 1.05. This means that fine-line reproducibility was good. In addition, no tailing of the fixed image was observed. Table 3 shows the results.

The evaluation criteria for fine-line reproducibility are shown below.

A: A ratio (line width ratio) of a measured line width to the line width of a latent image is less than 1.08.

B: The line width ratio is 1.08 or more and less than 1.12.

C: The line width ratio is 1.12 or more and less than 1.18.

D: The line width ratio is 1.18 or more.

The evaluation criteria for tailing of a fixed image are shown below.

A: No tailing is observed.

B: Tailing is slightly observed, but a fine-line image in which no tailing is observed is present.

C: Tailing is slightly remarkable, but is practically acceptable.

D: Tailing is remarkable.

An evaluation for roughness was performed by: outputting three solid black images after the 30,000-sheet durability test; and visually evaluating an outputted halftone image. As a result, the halftone image was an image that was uniform and had no unevenness. Table 3 shows the results.

The evaluation criteria for roughness are shown below.

A: No density unevenness of a halftone can be visually identified.

B: Nearly no density unevenness of a halftone can be visually identified.

C: The density unevenness of a halftone can be slightly identified, but is practically acceptable.

D: The density unevenness of a halftone is clear.

After the completion of the evaluation for roughness, the state of occurrence of a flaw on the surface of a photosensitive member was visually observed, and an influence on an image was observed. As a result, no occurrence of a photosensitive member flaw was observed. Table 3 shows the results.

The evaluation criteria are shown below.

A: Very good.

B: Good. The occurrence of a flaw is slightly observed on a photosensitive member, but has nearly no effect on an image.

C: The occurrence of a flaw is observed on a photosensitive member, but has a small effect on an image and is practically acceptable.

D: An image defect resulting from a flaw on a photosensitive member occurs.

Evaluation 2

The image output test machine and the process cartridge used in Evaluation 1 were left standing in a low-temperature-and-low-humidity environment of 15° C. and 10% RH overnight. In the process cartridge, the empty weight of the toner filling portion was weighed in advance, and the portion was filled with the magnetic toner 1. After they had been left standing overnight, a letter pattern having a printing ratio of 4% was continuously printed on 5,000 sheets of A4-sized plain paper (75 g/m$^2$). Subsequently, the weight of the toner filling portion was measured, and a toner weight in a container was recorded. After that, a letter pattern having a printing ratio of 4% was continuously printed on 20,000 sheets. Then, the weight of the toner filling portion was measured again, and a reduction in toner weight in the container was calculated. In accordance with the above procedure, an average toner consumption (mg/sheet) at the time of printing of 20,000 sheets was calculated. As a result, the average toner consumption was 48 mg/sheet.

Examples 2 to 6

Each of the magnetic toners 2 to 6 was evaluated in the same manner as in Example 1. Table 3 shows the results of the evaluation. In Example 5, an outputted solid black image was visually observed. As a result, the image looked slightly reddish although the image was practically acceptable.

Comparative Examples 1 to 4

Each of the comparative magnetic toners 7 to 10 was evaluated in the same manner as in Example 1. Table 3 shows the results of the evaluation. In Comparative Example 1, an outputted solid black image was visually observed. As a result, the image looked slightly reddish although the image was practically acceptable. In addition, in Comparative Example 2, the inside of the machine after the duration was observed. As a result, toner scattered, and the inside was considerably contaminated.

TABLE 3

Results of evaluation of Examples and Comparative Examples

| | Toner | Image density | Fogging | Scattering | Fine-line reproducibility | Tailing of fixed image | Roughness | Photosensitive member flaw | Toner consumption (mg/sheet) |
|---|---|---|---|---|---|---|---|---|---|
| Example 1 | Magnetic toner 1 | A | A | A | A | A | A | A | 48 |
| Example 2 | Magnetic toner 2 | A | A | A | B | B | B | A | 49 |
| Example 3 | Magnetic toner 3 | A | B | B | C | A | B | A | 47 |
| Example 4 | Magnetic toner 4 | B | A | A | B | A | B | A | 53 |
| Example 5 | Magnetic toner 5 | A | C | B | B | A | B | A | 46 |
| Example 6 | Magnetic toner 6 | B | A | B | B | C | B | B | 54 |
| Comparative Example 1 | Comparative magnetic toner 7 | B | C | B | C | C | B | C | 58 |
| Comparative Example 2 | Comparative magnetic toner 8 | C | D | D | D | B | C | B | 53 |
| Comparative Example 3 | Comparative magnetic toner 9 | C | D | C | C | B | C | B | 62 |
| Comparative Example 4 | Comparative magnetic toner 10 | C | C | C | D | D | C | D | 60 |

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the right of priority under 35 U.S.C. §119 based on Japanese Patent Application No. JP 2005-146715 filed May 19, 2005 which is hereby incorporated by reference herein in their entirety as if fully set forth herein.

What is claimed is:

1. A magnetic toner comprising at least:

a binder resin; and a magnetic body having thereon a high-density coating layer of at least one of $SiO_2$, $TiO_2$ or $Al_2O_3$, wherein the magnetic body comprises spherical particles, and wherein, when magnetization at a magnetic field strength of 397.9 kA/m and a coercive force of the magnetic toner are denoted by σs ($Am^2$/kg) and Hc (kA/m), respectively, a magnetic field strength at which the magnetic toner shows a magnetization value equal to 95% of σs is denoted by H95% (kA/m), and a number average particle size of the magnetic body is denoted by d (μm), H95%, Hc, and d satisfy the following expressions $$151<H95\%<200 \quad (1)$$

$$7.1<Hc<12 \quad (2)$$

$$40<Hc/d<150 \quad (3)$$

2. A magnetic toner according to claim 1, wherein the number average particle size d of the magnetic body is 0.08 to 0.19 μm.

3. A magnetic toner according to claim 1, wherein, when a magnetic field strength at which the magnetic toner shows a magnetization value equal to 90% of σs is denoted by H90% (kA/m), H90% satisfies the following expression $$111<H90\%<140 \quad (4)$$

4. A magnetic toner according to claim 1, wherein, when residual magnetization of the magnetic toner is denoted by σr (Am2/kg), σs and σr satisfy the following expression $$7.0<\sigma s/\sigma r<16.0 \quad (5)$$

* * * * *